US012680278B2

(12) United States Patent
Wood et al.

(10) Patent No.: US 12,680,278 B2
(45) Date of Patent: Jul. 14, 2026

(54) WEAR ASSEMBLY

(71) Applicant: ESCO GROUP LLC, Portland, OR (US)

(72) Inventors: Clinton A. Wood, Portland, OR (US); Cameron R. Leedham, Portland, OR (US); Christopher D. Snyder, Driggs, ID (US); Christopher E. Grewell, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 1110 days.

(21) Appl. No.: 17/722,239

(22) Filed: Apr. 15, 2022

(65) Prior Publication Data

US 2022/0333358 A1 Oct. 20, 2022

Related U.S. Application Data

(60) Provisional application No. 63/176,065, filed on Apr. 16, 2021.

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ... E02F 3/48; E02F 3/58; E02F 9/2808; E02F 9/2825; E02F 9/2833; E02F 9/2841; E02F 9/2875
See application file for complete search history.

(56) References Cited

U.S. PATENT DOCUMENTS

| | | | |
|---|---|---|---|
| 2,325,991 | A | 8/1943 | White |
| 2,861,362 | A | 11/1958 | Maurice et al. |
| 2,992,498 | A | 7/1961 | Mork |
| 3,312,004 | A | 4/1967 | Johnson |
| 3,371,437 | A | 3/1968 | Wilson et al. |
| 6,725,582 | B2 | 4/2004 | Adamic et al. |
| 7,658,025 | B2 | 2/2010 | Bentley |
| 7,788,830 | B2 | 9/2010 | Woerman et al. |
| 7,874,086 | B2 | 1/2011 | Briscoe et al. |
| 7,882,649 | B2 | 2/2011 | Carpenter et al. |
| 8,347,530 | B2 | 1/2013 | Clendenning et al. |
| 8,397,405 | B2 | 3/2013 | Harder et al. |
| 8,819,967 | B2 | 9/2014 | Campomanes |

(Continued)

FOREIGN PATENT DOCUMENTS

| | | | |
|---|---|---|---|
| AU | 2013205320 | B2 | 10/2015 |
| CA | 3136292 | A1 | 10/2020 |

(Continued)

*Primary Examiner* — Joseph M Rocca
*Assistant Examiner* — Robert E Pezzuto
(74) *Attorney, Agent, or Firm* — Palmer Dzurella

(57) ABSTRACT

A wear assembly for earth working equipment including a wear member including an exterior surface, an opening to receive a separable component, and a hole extending from the external surface to the opening. A lock in the hole to secure the separable component to the wear member, wherein the lock includes a collar and a pin that is adjustable within the collar so that the pin is movable inward to retain the separable component and movable outward to release the separable component. A magnet to secure the collar in the hole. The lock may pivot outwardly into the hole.

31 Claims, 17 Drawing Sheets

(56) References Cited

U.S. PATENT DOCUMENTS

| | | | | |
|---|---|---|---|---|
| 8,832,975 | B2 | 9/2014 | Itou et al. | |
| 9,027,268 | B2 | 5/2015 | Campomanes et al. | |
| 9,222,242 | B2 | 12/2015 | Yuan et al. | |
| 9,322,150 | B2 | 4/2016 | Johnston et al. | |
| 9,850,641 | B2 | 12/2017 | Hughes | |
| 10,519,632 | B2 | 12/2019 | Campomanes et al. | |
| 11,441,296 | B2 | 9/2022 | Bingham et al. | |
| 2002/0000053 | A1 | 1/2002 | Adamic et al. | |
| 2004/0148821 | A1 | 8/2004 | Keech et al. | |
| 2005/0229442 | A1 | 10/2005 | Jones et al. | |
| 2007/0084094 | A1 | 4/2007 | Bentley | |
| 2008/0000114 | A1 | 1/2008 | Bentley | |
| 2013/0333254 | A1* | 12/2013 | Wallis | E02F 9/2833 37/456 |
| 2014/0245645 | A1 | 9/2014 | Marchand | |
| 2015/0033595 | A1 | 2/2015 | Chenoweth et al. | |
| 2015/0082594 | A1 | 3/2015 | Pippins | |
| 2017/0051776 | A1 | 2/2017 | Samuelson et al. | |
| 2017/0226718 | A1* | 8/2017 | Snyder | E02F 9/2833 |
| 2019/0003156 | A1 | 1/2019 | Dare et al. | |
| 2019/0376254 | A1* | 12/2019 | Stolz | E02F 3/58 |
| 2020/0131742 | A1 | 4/2020 | Serrurier et al. | |
| 2022/0220710 | A1* | 7/2022 | Underwood | E02F 9/2891 |

FOREIGN PATENT DOCUMENTS

| | | | |
|---|---|---|---|
| CN | 104452869 | B | 8/2016 |
| CN | 108729495 | A | 11/2018 |
| CN | 211690509 | U | 10/2020 |
| EP | 0203315 | A2 | 12/1986 |
| EP | 2246489 | A2 | 11/2010 |
| JP | 3151537 | U | 6/2009 |
| JP | 2020114969 | A | 7/2020 |
| WO | 2013009952 | A1 | 1/2013 |
| WO | 2013090254 | A1 | 6/2013 |
| WO | 2014153591 | A1 | 10/2014 |
| WO | 2020113261 | A1 | 6/2020 |
| WO | 2020237326 | A1 | 12/2020 |

* cited by examiner

WEAR ASSEMBLY

RELATED APPLICATIONS

This application claims priority benefits to U.S. Provisional Patent Application No. 63/176,065, filed Apr. 16, 2021, and entitled "Wear Assembly," which is incorporated herein by reference in its entirety.

FIELD OF THE DISCLOSURE

This disclosure pertains to wear assemblies for earth working equipment, and to the wear members, bases, and/or locks of the wear assemblies.

BACKGROUND OF THE DISCLOSURE

Earth working equipment, such as earth working buckets and the like, are used for demolition, mining, earth moving, and other similarly harsh applications. To protect the earth working equipment from wear and/or to enhance the operation of the equipment, wear parts may be attached to the earth working equipment. Such wear parts may include points, adapters, shrouds, and the like. Such wear parts are commonly subjected to harsh conditions, heavy loading, and extreme abrasion. Accordingly, the wear parts wear down over time and must be replaced, often in the field and under less than ideal conditions.

SUMMARY OF THE DISCLOSURE

This disclosure relates to wear members for wear assemblies for earth working equipment. This disclosure also includes a wear member and lock combined as a single integral component, i.e., the wear member includes a wearable body and a lock joined together. This disclosure also relates to the locks, wear members (e.g., points, adapters, shrouds, shredding hammers, runners, etc.) and the bases individually.

In one other example, a wear assembly includes a wear member having a mounting portion for engaging a base for mounting the wear member to the earth working equipment. The mounting portion having an internal surface for mating with the base and an opposite external surface, a hole extending from the external surface to the internal surface, and a lock integrally mounted in the hole from the internal surface. The lock being adjustable for movement between a locked position where the lock is positioned to contact the base to hold the wear member to the equipment and a release position where the lock is positioned to release the base while the lock remains in the hole. The lock includes at least one magnet to capture the lock to the wear member.

In another example, a process of assembling a wear assembly includes providing a wear member having a cavity defined by an interior surface with a lock recess, magnetically attaching a collar of a lock into lock recess from the cavity of the wear member, and inserting a pin through a bore in the collar of the lock.

In another example, a lock for securing a wear member to equipment may include: a collar with a threaded opening and a magnet; a threaded pin for engagement with the collar and a base to lock the wear member to the base. The magnet locking at least the collar to an interior surface of the wear member in an install position. The wear member and the lock attached in the install position are capable of being shipped as a single wear assembly.

In a further example, a wear assembly includes a wear member having a mounting portion for engaging a base (for mounting the wear member to the earth working equipment), the mounting portion having an internal surface for mating with a base and an opposite external surface, a hole extending from the external surface to the internal surface, and a lock integrally mounted in the hole from the internal surface for movement between a locked position where the lock is positioned to contact the base to hold the wear member to the equipment and a release position where the lock is positioned to release the base while the lock remains in the hole. The lock includes a collar having at least one magnet to capture the lock on the internal surface of the wear member, and a movable pin passing through the collar.

In one other example, a wear assembly includes a wear member having a mounting portion for engaging a base for mounting the wear member to earth working equipment and an exterior surface. The mounting portion has an interior surface for mating with a base, wherein the interior surface defines a recess and a hole extending through the wear member from the exterior surface to the interior surface. The recess has a front wall with a support projecting into the recess for a lock to engage and swing outward to engage the wear member. The recess includes a portion opposite the support for receiving a portion of the lock with a magnet to retain the lock in the swung position.

In another example, a process of assembling a wear assembly includes providing a wear member having a cavity defined by an interior surface with a lock recess, pivoting a collar of a lock about one side of the collar and magnetically attaching a collar of a lock into lock recess from the cavity of the wear member on the other side of the collar, and inserting a pin through a bore in the collar of the lock.

In another example, a lock includes a collar having a bearing surface on one end with a magnet to hold the lock to an interior surface of a wear member, an opening, and a recess at a one end to receive a support located on the interior surface of the wear member about which the collar will rotate into an install position from the interior surface of the wear member to releasably hold the wear member to the equipment, and a pin to pass through the opening in the collar.

In a further example, a wear assembly includes a wear member having a mounting portion for engaging a base for mounting the wear member to earth working equipment and an exterior surface. The mounting portion of the wear member has an interior surface for mating with a base, and the interior surface defines a recess including a hole extending through the wear member from the exterior surface to the interior surface. This recess has a support projecting into the recess to engage and swing a lock outward to engage the wear member and partially hold the lock to the wear member from the interior surface of the mounting portion.

In one other example, a process of assembling a wear assembly includes providing a wear member having a cavity defined by an interior surface with a lock recess, pivoting outward a collar of a lock about one side of the collar from an interior surface of the cavity, and inserting a pin through a bore in the collar of the lock.

In another example, a lock includes a collar having an opening and a recess at one end to receive a support on a wear member about which the collar rotates into an install position from the interior surface of the wear member, and a pin to pass through the opening of the collar and releasably hold the wear member to the equipment.

In another example, a process of shipping a wear assembly includes providing a wear member having a cavity defined by an interior surface with a lock recess, magnetically attaching a collar of a lock to the wear member about at least one side of the collar from an interior surface of the cavity, inserting a pin through a bore in the collar of the lock, and shipping the wear assembly.

In a further example, a wear assembly includes a wear member having a mounting portion for engaging a base for mounting the wear member to earth working equipment and an exterior surface. The mounting portion has an interior surface for mating with a base. The interior surface defines a hole including a recess in the interior surface. A lock having a pin and a collar is trapped and supported between the wear member and a base. The collar having a pass through bore is threaded, sized and shaped for the pin to pass through.

In one other example, a base includes a nose sized and shaped to mate with a cavity of a wear member. The base has a lock hole, wherein the lock hole is defined by an interior surface. The interior surface is substantially circular and having two flat sections on one side for a pin of a lock to engage.

In another example, a wear member includes a lock access recess in the interior surface with a lock hole that passes through the wear member and opens to the interior of the wear member and to an exterior. The lock access recess being sized and shaped to mate with a collar of a lock, with one side of the recess fulling engaging the collar and the other side only engaging a portion of the side of the collar.

In another example, a wear assembly for earth working equipment includes a wear member and a lock for releasably securing the wear member to a base, wherein the lock is secured to the wear member by at least one magnet.

In another example, a wear assembly for earth working equipment includes a wear member with a mounting cavity for receiving the base, and a hole that opens in the mounting cavity and an exterior surface of the wear member. A collar is secured to the wear member by at least one magnet so that a through-hole in the collar is aligned with the hole in the wear member. A pin is movably secured within the through-hole for releasably holding the wear member to the base.

In another example, a wear assembly for earth working equipment includes a wear member, a collar and a pin. The wear member has a mounting cavity for receiving a base, and a hole that opens in the mounting cavity and an exterior surface of the wear member. The collar includes a through-hole aligned with the hole in the wear member for movably receiving and securing the pin so the pin can releasably hold the wear member to the base. The collar and the wear member include a complementary projection and recess to permit the collar to pivot into place from the cavity. Optionally, at least one magnet can be included to hold the collar to the wear member.

In another example, a wear member for earth working equipment has a mounting cavity for receiving a base, a hole that opens in the mounting cavity and an exterior surface of the wear member, and a projection or recess to cooperate with and pivot at least a component of a lock from the cavity and into an installed position in the hole. Optionally, at least one magnet can be included to hold the collar to the wear member.

In a further example, a first component of a wear assembly for earth working equipment includes a mounting cavity for receiving a second component, a hole that opens in the mounting cavity and an exterior surface of the first component, and a projection or recess to cooperate with and pivot at least a component of a lock from the mounting cavity and into an installed position in the hole. Optionally, at least one magnet can be included to hold the collar to the first component.

In one further example, a wear assembly for earth working equipment includes a wear member including an exterior surface, an opening to receive a separable component, and a hole extending from the external surface to the opening. A lock in the hole to secure the separable component to the wear member, wherein the lock includes a collar and a pin that is adjustable within the collar so that the pin is movable inward to retain the separable component and movable outward to release the separable component. A magnet to secure the collar in the hole.

In an example, a wear assembly for earth working equipment includes a wear member including an exterior surface, an opening for receiving a separable component, a hole extending from the external surface to the opening, the hole having an outer portion adjacent the exterior surface and an inner portion forming a recess in the opening wherein the recess surrounds the outer portion, and a pivot support on one side of the recess. A lock in the hole wherein the lock includes a collar and a pin that is adjustable within the collar to move inward to retain the separable component and outward to release the separable component, the collar including a pivot formation to engage the pivot support to pivot the collar into the recess.

In another example, a wear member for earth working equipment includes an exterior surface, an opening for receiving a separable component, a hole extending from the external surface to the opening, the hole having an outer portion adjacent the exterior surface and an inner portion forming a recess in the opening wherein the recess surrounds the outer portion, and a pivot support on one side of the recess to facilitate pivoting of a collar of a lock into the recess so the lock can retain the separatable component in the opening.

In a further example, a lock for securing a wear member for earth working to a separable component, the lock includes a collar including a body, at least one projection extending from one side of the body, a threaded opening extending through the body, and at least one magnet to hold the collar to an interior surface of the wear member in an install position; a threaded pin in the threaded opening in the collar that is adjustable within the collar to move inward and outward of the separable component.

In one further example, a lock for securing a wear member for earth working to a separable component, the lock includes a collar including a pivot formation on one end of the collar to facilitate pivoting of the collar into a usable position against an interior surface on the wear member, a threaded opening extending through the collar, and at least one magnet to hold the collar to a wear member; and a threaded pin in the threaded opening in the collar which is adjustable inward and outward of the separable component.

A process for installing a lock in a wear member for earth working equipment, the process includes the steps of 1) providing a wear member having an opening for receiving a separable component, and a transverse hole that intersects the opening; 2) installing a collar with a through-hole into the opening and against an interior surface of the opening so the through-hole is aligned with the transverse hole in the wear member; 3) providing a magnet on the wear member and/or the collar to secure the collar to the wear member; and 4) inserting a pin in the through-hole in the collar that is adjustable toward and away from the opening.

The advantages of the locks and wear assemblies of the present disclosure will be more readily understood after considering the drawings and the Detailed Description.

DETAILED DESCRIPTION OF THE DISCLOSURE

The present disclosure pertains to a wear assembly for earth working equipment. While the disclosure herein includes examples of securing a ground engaging tool (which in this example is shown as a point) to an adapter, wear assemblies in accordance with this disclosure may be used in securing other kinds of wear parts such as intermediate adapters, shrouds, runners, picks, hammers, rigging components, etc. Likewise, although excavating buckets are disclosed herein as the earth working equipment, other kinds of earth working equipment could be used such as dredge cutter heads, shredders, rigging equipment, roll crushers, chutes, truck bodies, etc. Relative terms such as front, rear, top, bottom and the like are used for convenience of discussion. The terms front or forward are generally used to indicate the normal direction of travel during use (e.g., while digging), and upper or top are generally used as a reference to the surface over which the material passes when, for example, it is gathered into the bucket. Nevertheless, it is recognized that in the operation of various earth working machines the wear assemblies may be oriented in various ways and move in all kinds of directions during use.

Figure 1:
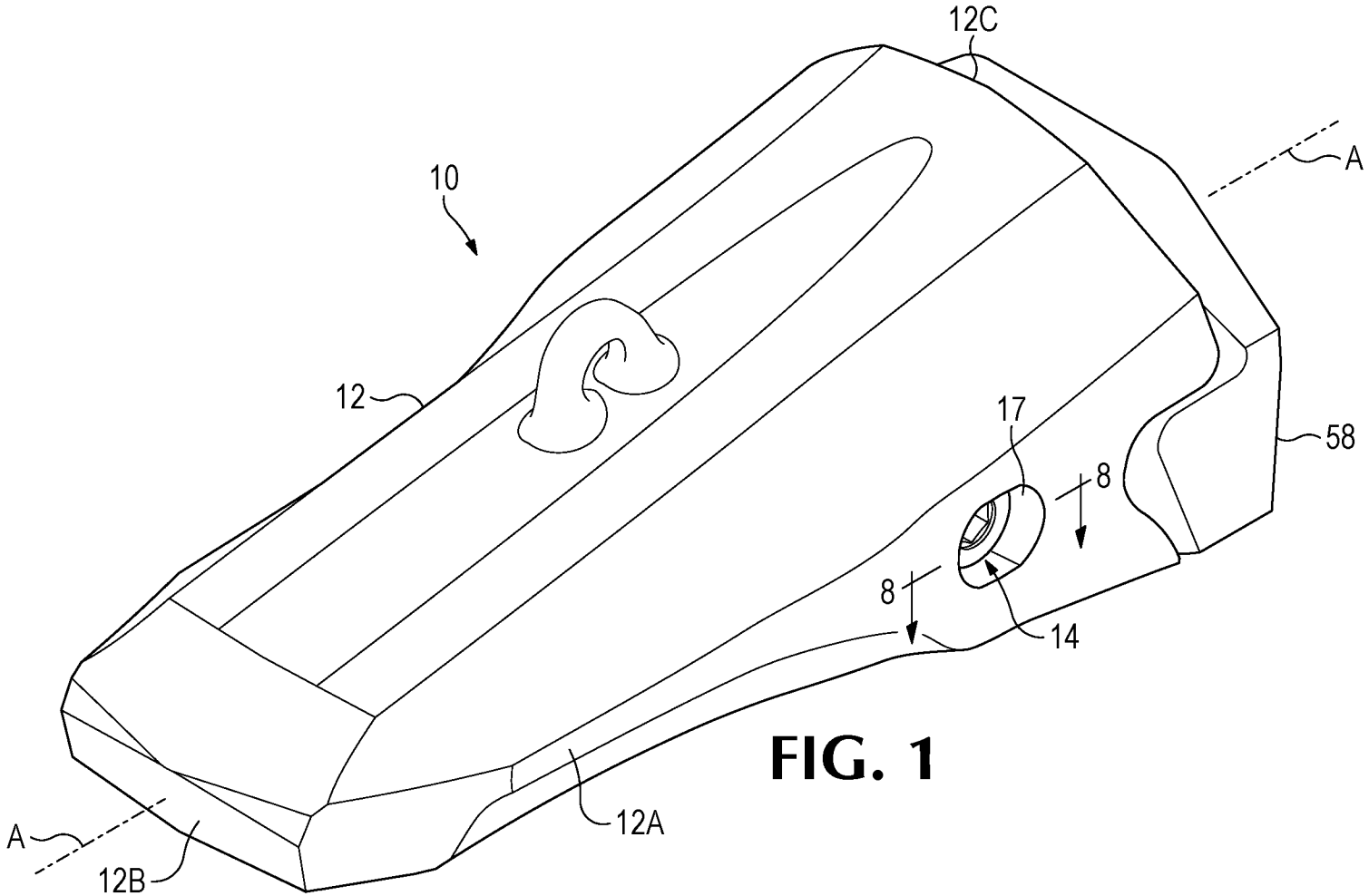
FIG. 1 is a perspective view of a wear assembly including a wear member, a base, and a lock according to the disclosure.
Figure 2:
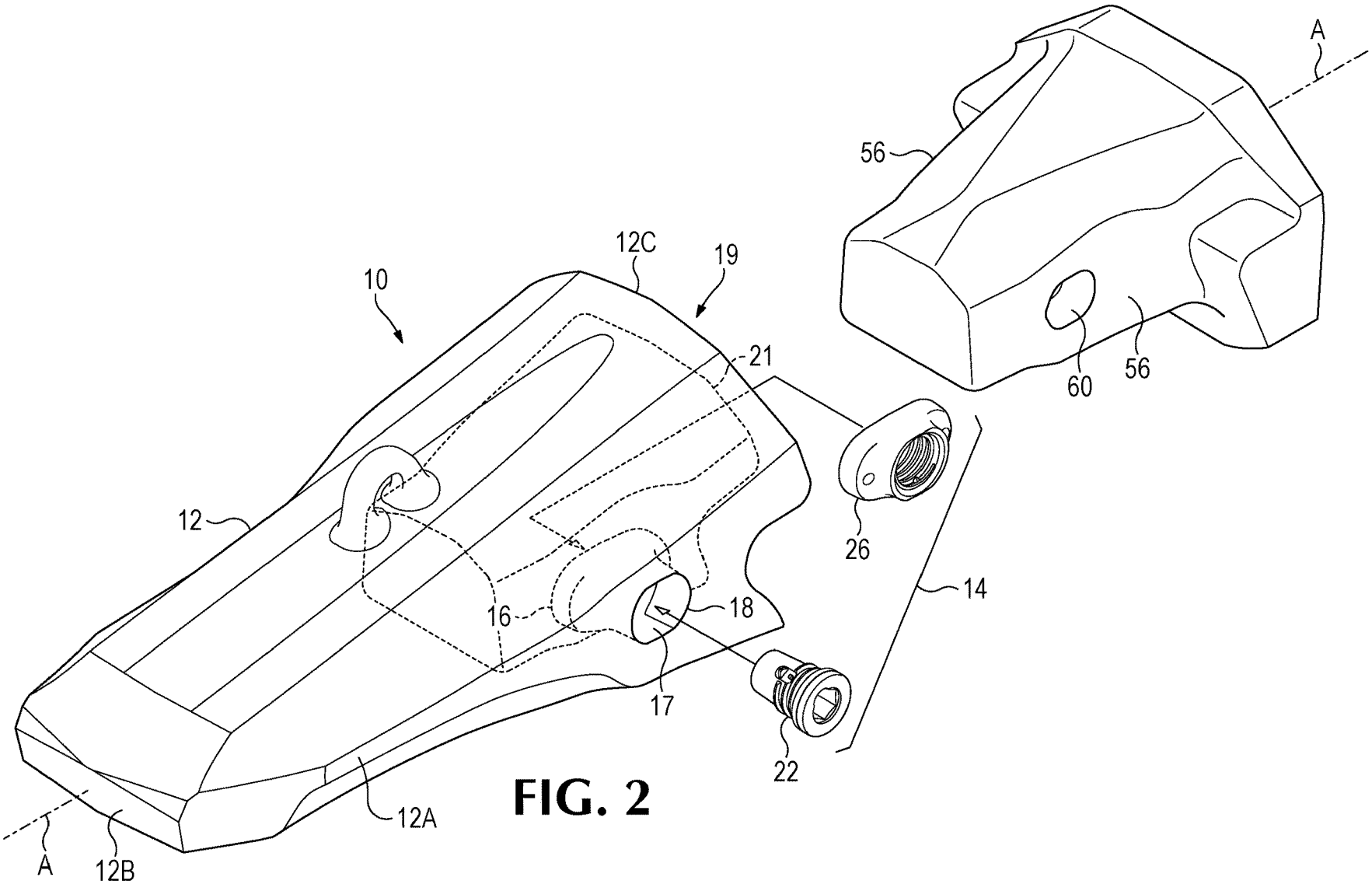
FIG. 2 is a partial exploded view of the wear assembly of FIG. 1.

In the illustrated example of FIGS. 1-2, wear assembly 10 includes two separate components and a lock, e.g. a wear member 12, a base or separable component 58, and a lock 14. Alternatively, the wear member 12 and lock 14 combination may be considered a wear assembly 10, which may optionally be sold, shipped, stored, and/or installed as a single unit. Wear member 12 is shown as a point having a working portion 12A that converges to a narrowed front end 12B to penetrate the ground during digging, and a mounting portion 12C with a rearwardly-opening cavity 19 defined by an interior surface 21 for receiving the base 58. The working portion 12A is forward of cavity 19 and the mounting portion 12C is rearward of working portion 12A in the longitudinal direction A.

Figure 3:
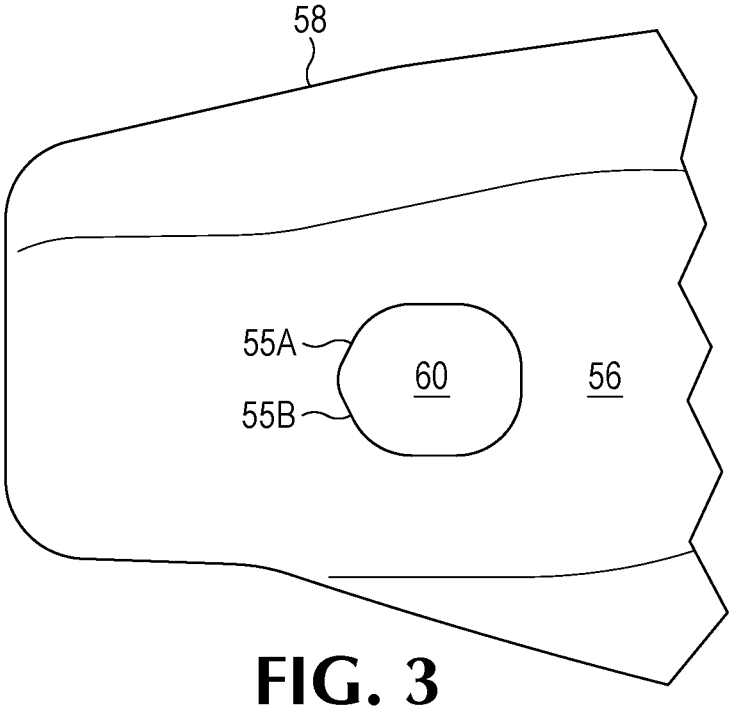
FIG. 3 is a partial perspective view of the base of FIG. 1
Figure 4:
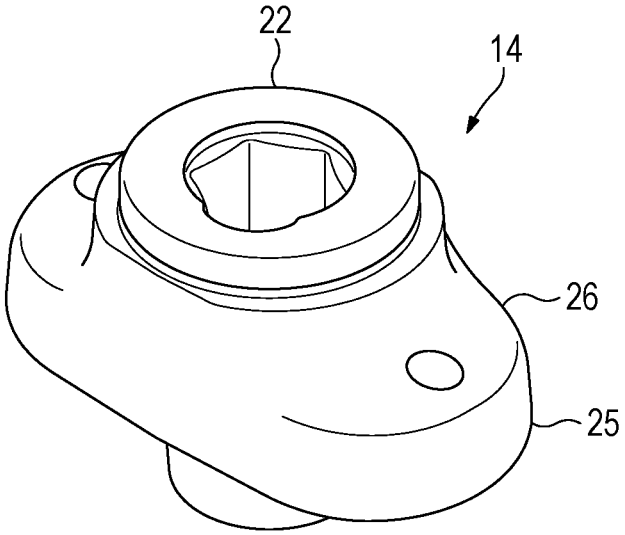
FIG. 4 is a perspective view of the lock of FIG. 1.

The base 58 may be an integral portion of the earth working equipment (such as a digging edge of a bucket) or may be a separate component attached to such equipment (e.g., an adapter) by, e.g., welding, or mechanical attachment. The cavity 19 and base 58 received therein are complementary shaped to suitably support the wear member 12 during use. In this embodiment, base 58 is a nose of an adapter or cast lip. In the illustrated example, the cavity and nose are generally as described in U.S. Pat. No. 7,882,649 (incorporated herein by reference) but a wide range of cavity and nose configurations could be used. Nose 58 includes an opening 60 to receive a leading end 27 of pin 22 to secure the wear member to the base (FIG. 3).

The lock 14 is a coupling arrangement for securing two separable components in an earth working operation. Referring to FIGS. 4-9, the lock 14 includes a mounting component or collar 26 and a retaining component or pin 22. The lock 14 is received into a hole 17 that extends through a wall of the wear member and communicates with mounting cavity 19. In the illustrated embodiment, the hole 17 extends through a sidewall of point 12 but it could extend through other walls. As examples only, the hole 17 could extend through the other sidewall or the top wall of point 12. A plurality of holes 17 (e.g., in each sidewall) could be used to secure a plurality of locks to hold the wear member 12 to the base 58. In other wear members, the hole(s) 17 may extend through bottom, top, or other walls of the wear member. In wear members with a shank (not shown) instead of a mounting cavity, hole 17 extends through the base having a cavity to receive the shank. In this arrangement, the hole 60 is formed in the shank. In the illustrated embodiment, hole 17 includes an inner portion or recess 16 that opens into cavity 19 and an outer portion or passage 18 opening in the exterior surface of wear member 12. Passage 18 is narrower in this example to define a shoulder or recessed surface 35 to hold the collar 26 from moving outward, but other arrangements (e.g., projections, fasteners, etc.) for holding the collar 26 could be used. Also in the illustrated example, recess 16 and passage 18 each narrows in an outward direction (e.g., for manufacturing purposes), but they could have other shapes.

The collar 26 has a body 25 that fits in recess or lock receiving area 16 of wear member 12 and includes a bore or opening 26A. The illustrated bore includes threads 26B for receiving the pin 22 with matching threads 22B, but other configurations without threads to secure and move the pin relative to the collar are possible (e.g. prying latches, oil pressure, etc.). In the illustrated example, the body 25 includes an inner portion 31 that is received in recess 16 and an outer portion 30 that is received in passage 18. The inner portion 31 is elongated to be larger than passage 18 to resist outward movement during use. The outer portion 30 is smaller for receipt into passage 18 to ensure alignment of bore 26A with hole 17 and/or provide a longer run of threads. Nevertheless, other collar shapes are possible.

Figure 8:
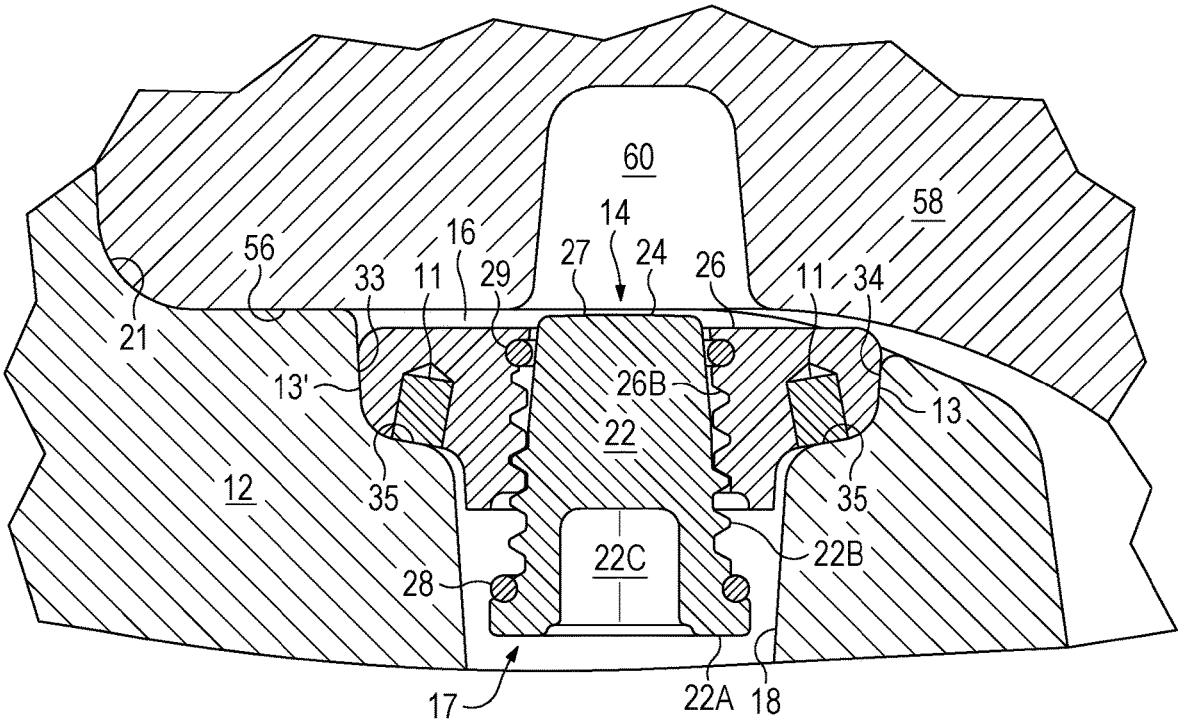
FIG. 8 is a cross-section view taken along line 8-8 in FIG. 1 with the lock in the release position.

The collar 26 includes at least one magnet 11 to secure the collar 26 and/or lock 14 in recess 16. In the illustrated example, two magnets are located near each respective end 13, 13' on an outer surface 30 of collar 26, though other locations and numbers of magnets 11 are possible. Each magnet 11 may be installed into an open-ended hole 11A (which in this example is a blind hole) or otherwise secured to the collar 26. The magnet 11 and hole 11A are illustrated as cylindrical, but other shapes are possible. The magnet(s) could alternatively be secured to the wear member in hole 17. The magnets 11 can hold the collar 26 and, when pin 22 is installed, the lock 14 in place within wear member 12 during shipment, storage, and/or installation of wear member 12. This arrangement can permit the wear member 12 to be installed on base 58 without first moving or removing the lock 14 from the wear member 12. In some examples, the lock 14 is preferably held to wear member 12 in a first or release position, where the inner end 27 of pin 22 is located within the collar 26, so the lock 14 does not obstruct installation of wear member 12 onto a base 58 (FIG. 1). The inner end 27 could be inward of the collar 26 in the release position so long as it cleared the base during installation (FIG. 8).

Figure 5:
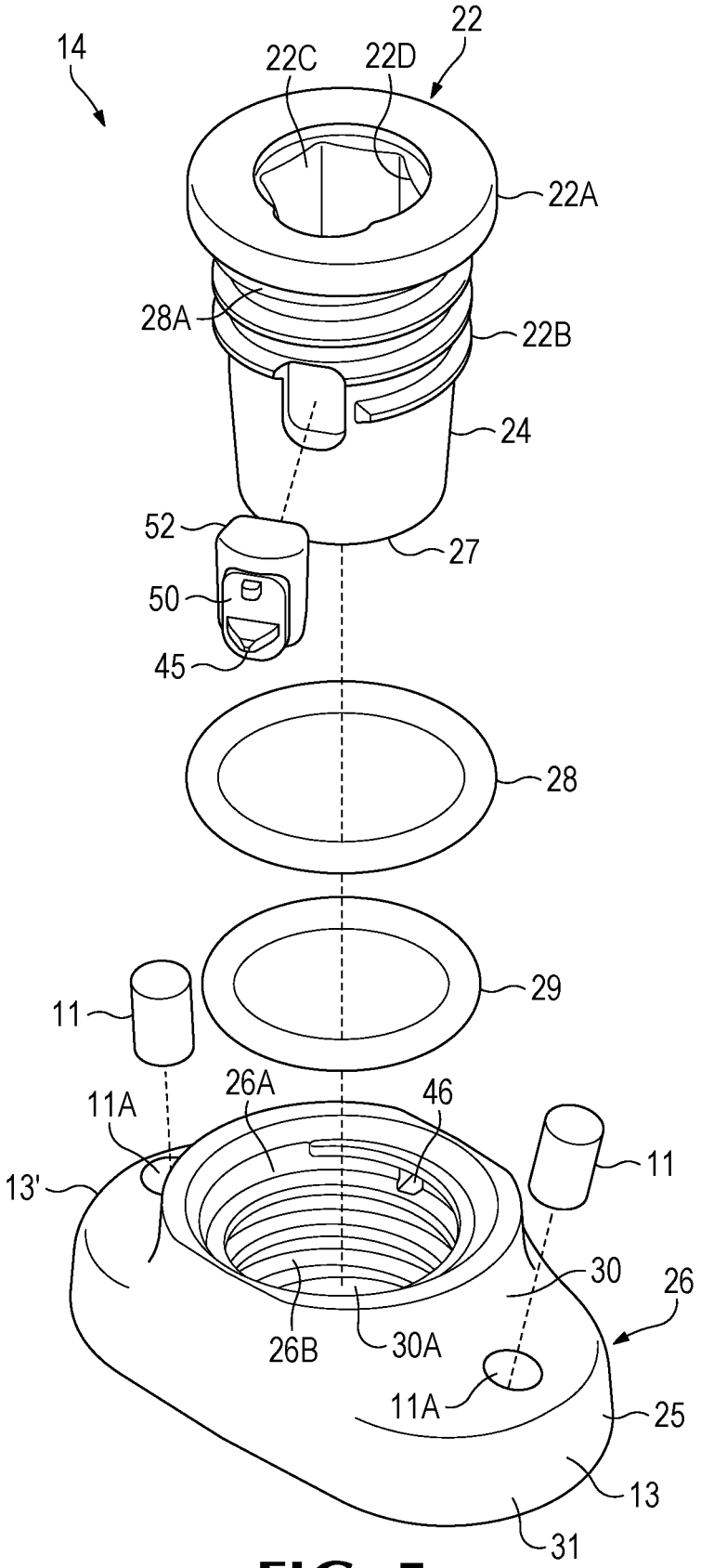
FIG. 5 is an exploded view of the lock of FIG. 1.
Figure 6:
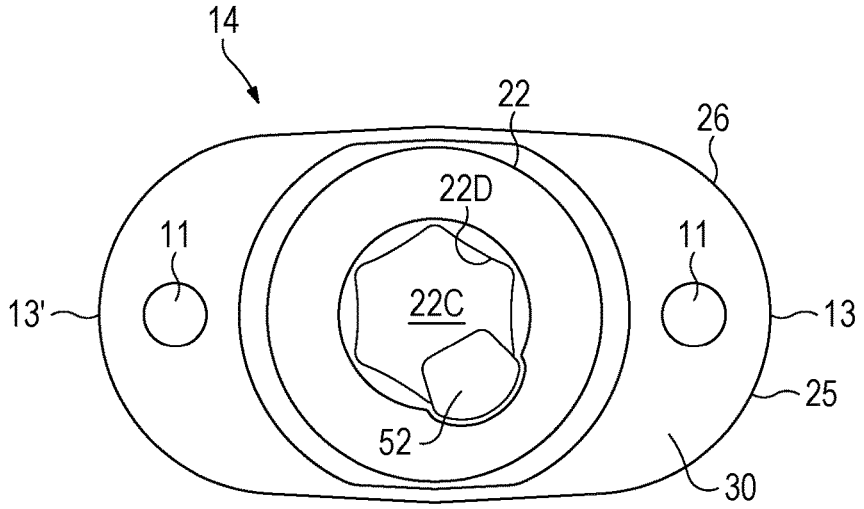
FIG. 6 is a top view of the lock in FIG. 1.

The pin 22 may be similar to the pin disclosed in U.S. application Ser. No. 16/671,096, which is incorporated by reference in its entirety. The pin 22 includes a tool-receiving formation 22C for turning the pin 22. In the illustrated example, the formation 22C includes a hole with facets 22D in head 22A for receiving, e.g., a hex wrench tool. The pin 22 can include a distal tapering shank 24 extending away from the head with threads 22B. In this example, an outer seal 28 is retained in a recess 28A located inward of the head 22A on pin 22 (FIG. 5). The outer and inner seals 28, 29 provide a closed thread space for the assembled lock. The seals could be reversed so that the inner seal is on the pin and the outer seal on the collar. Further, either seal 28, 29 could be positioned on the collar or the pin in alternative examples. In other examples, one or both seals 28, 29 may not be used.

In one preferred example, the threaded pin 22 includes an optional latch or detent 45 biased to protrude beyond the surrounding thread 22B. A corresponding outer pocket or recess 46 is formed in the thread 26B of collar 26 to receive detent 45, so that threaded pin 22 latches into a specific position relative to collar 26 when latching detent 45 aligns and inserts with an outer pocket. Preferably, latching detent 45 is located at the start of the thread 22B on threaded pin 22, nearer to the pin end 27 than to the pin head 22A. Preferably, latching detent 45 may be formed of sheet steel, held in place within a sump 52 within pin 22, and resiliently fixed to an elastomer 50. The elastomer 52 may, e.g., be molded around latching detent 45 so that elastomer 52 hardens in place and bonds to latching detent 45. The latch 45 could alternatively be in the collar 26 and pocket 46 in the pin 22.

The use of a single integral wear member 12 and lock 14 reduces the number of parts to be held in an inventory. Such a construction reduces inventory and storage needs, eliminates dropping the lock during installation (which can be particularly problematic at night), ensures the proper lock is always used, and eases the installation of the wear member. Nevertheless, if desired, pin 22 could be removed at any time. The collar 26 is preferably a single unit (one piece or assembled as a unit), and preferably a one-piece construction for strength and simplicity. Likewise, the pin 22 is preferably one single unit of a one-piece construction for strength and simplicity. Nevertheless, the collar and/or pin could be formed of multiple pieces. While the collar and pin are preferably assembled into wear member 12 at the time of manufacture, the collar 26 and the pin 22 could be installed at other times. For example, the collar 26 with or without the pin 22 could be installed at the worksite prior to installation to a base. If the collar 26 is installed without the pin 22, the pin 22 could be inserted from the outside to secure the wear member 12 to the base 58.

The recess 16 is an opening in the interior surface 21 of the wear member 12 and is structured to receive and cooperate with the collar 26 of the lock 14, i.e., the collar is fit into hole 17 from the within cavity 19. The recess 16 surrounds a passage 18 to receive a pin 22 and the inner portion 30 of the collar 26 of the lock 14. The recess 16 and/or passage 18 may be an elongate circle shape defined by an inner surfaces 33, 34, but other shapes are possible.

Figure 7:
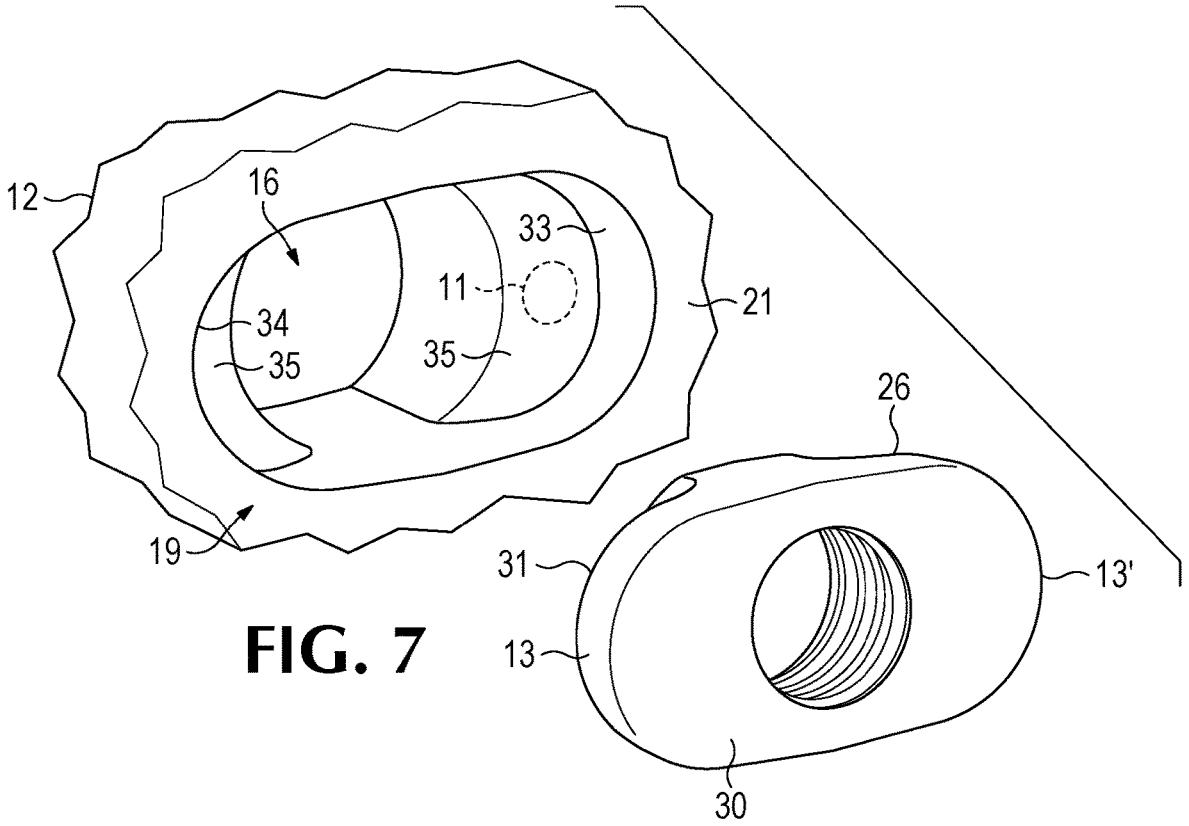
FIG. 7 is a partial cross-section view of the interior of the wear member of FIG. 1 with the lock being installed prior to mounting to the base.
Figure 9:
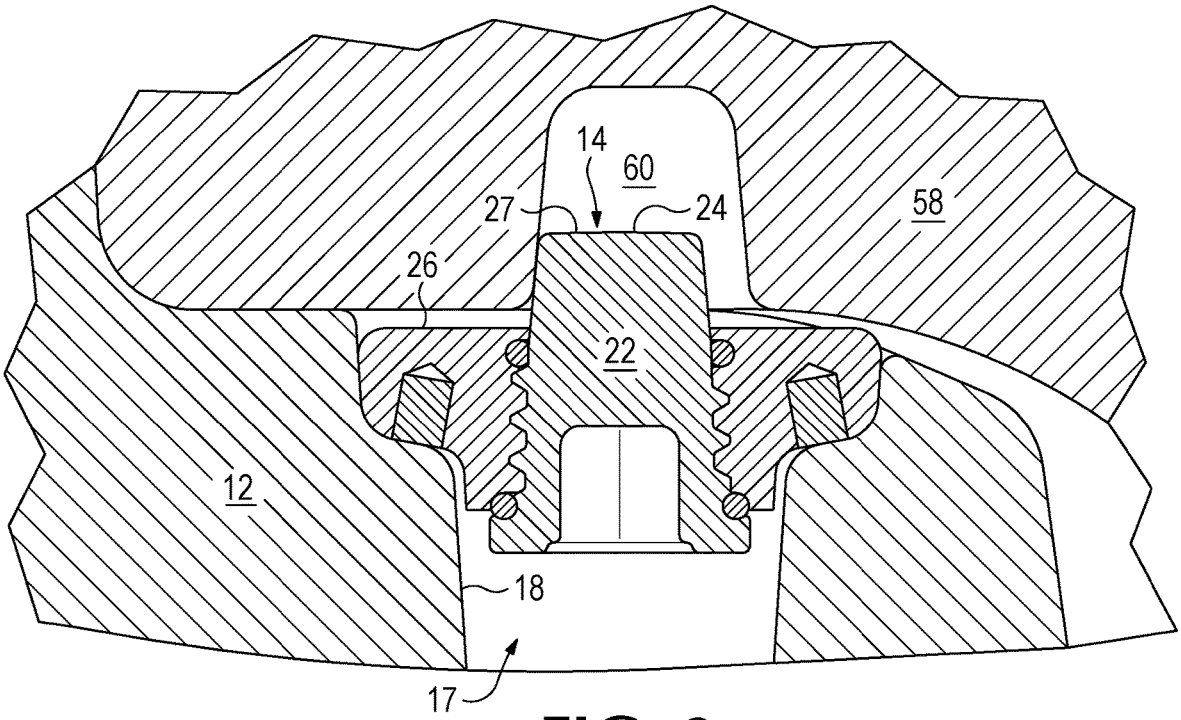
FIG. 9 is a partial cross-section view taken along line 8-8 in FIG. 1 with the lock in the locked position.

Referring to FIGS. 7-9, to install the lock 14, the collar 26 is inserted into recess 16 from within cavity 19, such that, the magnets 11 on the collar engage a recessed surface 35 in recess 16 on either side of the hole 17, and the outer portion 30 is received within the hole 17. An alternative location for the magnets 11 is shown in phantom in the recessed surface 35. The magnets 11 may be flush with recessed surface 35. Surfaces defining recess 16 resist turning of the collar 26 during installation and/or adjustment of pin 22. The recess 16 also includes front and rear surfaces 33, 34, 35 to support collar 26. In the illustrated example, the rear surface 34 has a smaller inward extension than the front surface to accommodate the expansion of nose 58 though other arrangements are possible. Further, the rear surface 34 and/or front surface 33 provides a resistive couple against the cantilever and other loads applied to pin 22 during use. While the magnets 11 function to hold the collar 26 in recess 16 at all times they are primarily for holding the collar during installation of pin 22 as well as during the shipping, storage and/or installation of wear member 12. The opposition of the nose 58 to the collar 26 when wear member 12 is assembled on the base prevents the collar 26 from moving out of recess 16 during use.

The pin 22 can be installed into collar 26 from outside the wear member 12 so that pin end 27 is the leading end 27 and pin threads 22B engage collar threads 26B, but could be connected to collar 26 and installed into hole 17 with collar 26. The leading end 27 is preferably unthreaded for receipt into a hole 60 in the side 56 of the nose 58. The engagement of latching detent 45 in outer pocket 46 holds threaded pin 22 in a release position relative to collar 26, which holds pin 22 outside of cavity 19 (or at least outside of hole 60 with sufficient clearance on nose 58), so that the wear member 12 can be installed on (and/or removed from) nose 58 (FIG. 8). The pin 22 is preferably shipped and stored in the release position so that wear member 12 is ready to install while the collar 26 is captured in the recess 16 but it need not be. In other examples, the pin may not include a latching detent and just function to lock the wear member 12 to the base.

Further application of torque to pin 22 will squeeze latching detent 45 out of outer pocket 46. An inner pocket or recess is optionally formed at the inner end of the thread of collar 26 and puts the lock in the locking position (FIG. 9). The leading end 27 when fully inserted will engage in hole 60 to secure the wear member 12 to the base 58 (FIG. 9). Referring to FIG. 3, the base opening 60 may include two flat sections or flats 55A, 55B about at least a portion of the depth of the hole 60. The flats 55A, 55B are illustrated as being located on a forward end of the inner wall of the opening 60 to provide two contact points for the leading end 27 of the pin 22, though other locations are possible. The flats 55A, 55B may reduce stress on the pin 22 and reduce lock hole wear from the engagement of the lock in use and removal. Nevertheless, a curved or other non-linear shaped sections could be used.

To remove wear member 12 from base 58, the pin 22 may be released using a torque-applying tool (e.g., a torque wrench) to unscrew pin 22 from collar 26. While pin 22 can be removed from collar 26, it need only be backed up to the release position without completely removing the pin 22. Wear member 12 can then be removed from nose 58. The torque of unscrewing pin 22 may exert substantial torsion loads on collar 26, which are resisted by shelf surface 33.

The use of a lock in accordance with the present disclosure can provide many benefits: (i) the lock can be integrated into the wear member so that the lock ships and stores in a ready to install position for less inventory and easier installation; (ii) the lock requires only common drive tools (such as a hex tool) for easy use; (iii) the lock requires no hammer for safe operation; (iv) the lock provides easy tool access for ready installation and/or removal; (v) the lock can provide visual and/or haptic confirmation of correct installation; (vi) a new lock can be provided with each wear part for enhanced reliability and/or ease; (vii) the lock has a simple, intuitive operation that makes it easy to use; (viii) the lock can have an integration system built around simple castable feature where the integration supports high loads, requires no special tools or adhesives and creates a permanent assembly; (ix) a magnet holds the collar to the wear member in a quick and easy install position; and/or (x) the lock is located within an interior of the wear assembly to protect the lock from wear and reduce the risk of lock ejection.

Figure 10:
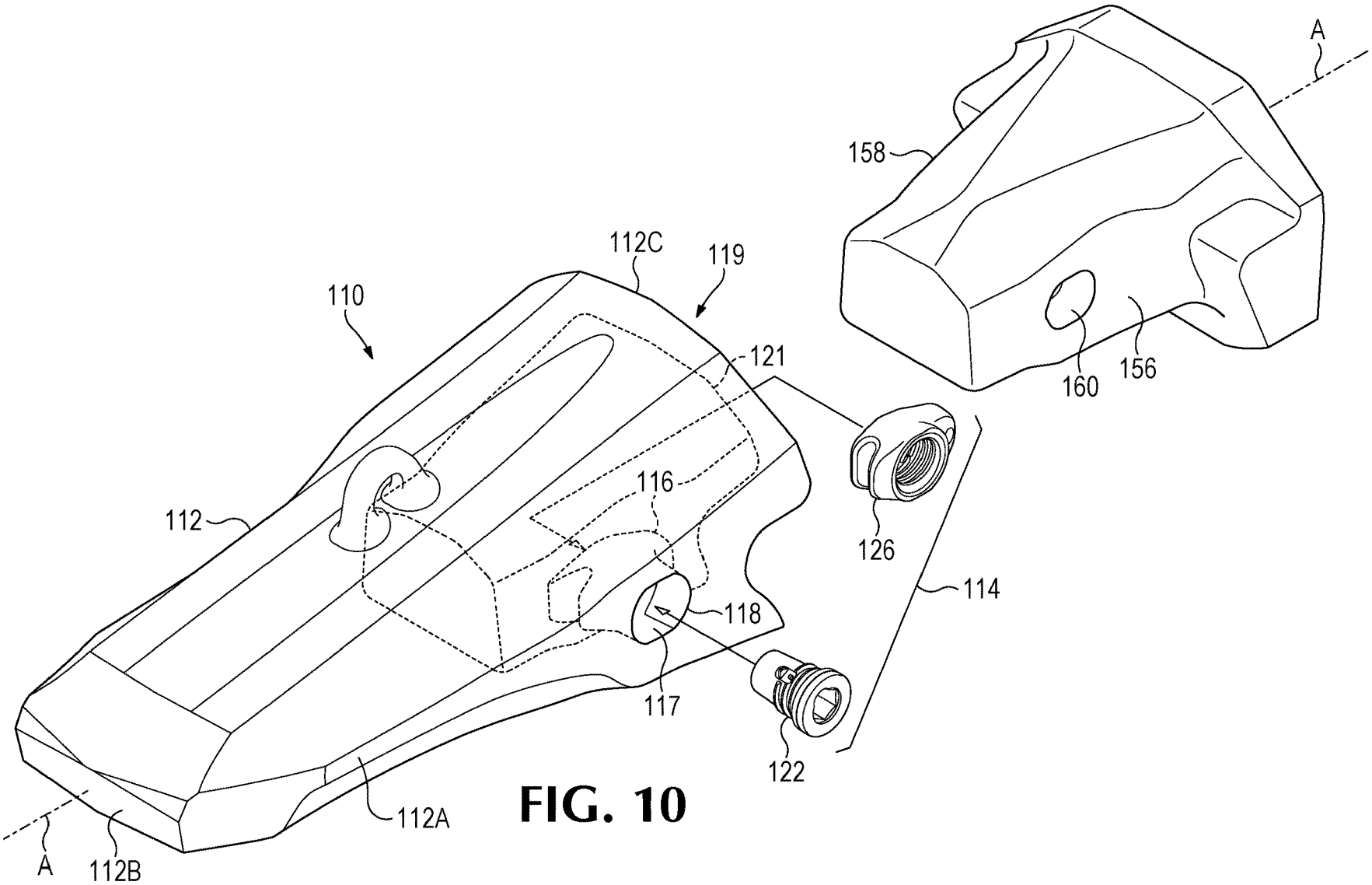
FIG. 10 is a partial exploded view of a second wear assembly including a wear member and a lock according to the disclosure.

In the illustrated example of FIG. 10, a wear assembly 110 includes a wear member 112, a base 158, and a lock 114. The wear member 112 and base 158 are substantially similar to wear member 12 and base 58, with the exception of some distinctions that will be further discussed below.

In the illustrated example, the wear member 112 is shown as a point having a working portion 112A in the form of a narrowed front end 112B to penetrate the ground during digging, and a mounting portion 112C with a rearwardly-opening cavity 119 defined by an interior surface 121 for receiving the base 158.

The wear member 112 includes a cavity 119 that is shaped generally to accept the base 158 therein and includes an opening 160 that is sized and shaped to engage an inner end 127 of pin 122 to secure the wear member 112 to the base 158. The opening 160 may optionally include the two linear sections as discussed above.

Figure 11:
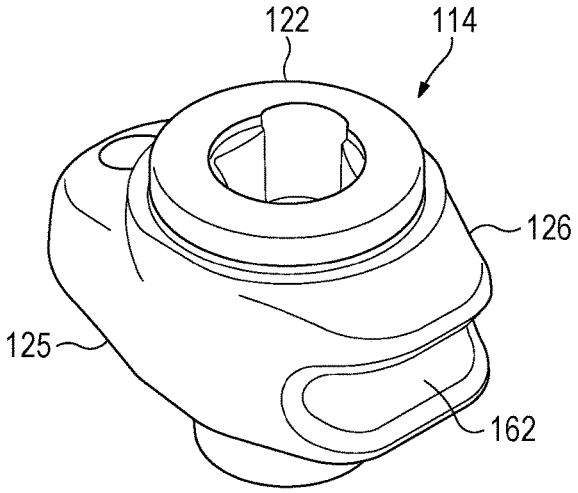
FIG. 11 is a perspective view of the lock of FIG. 10.
Figure 12:
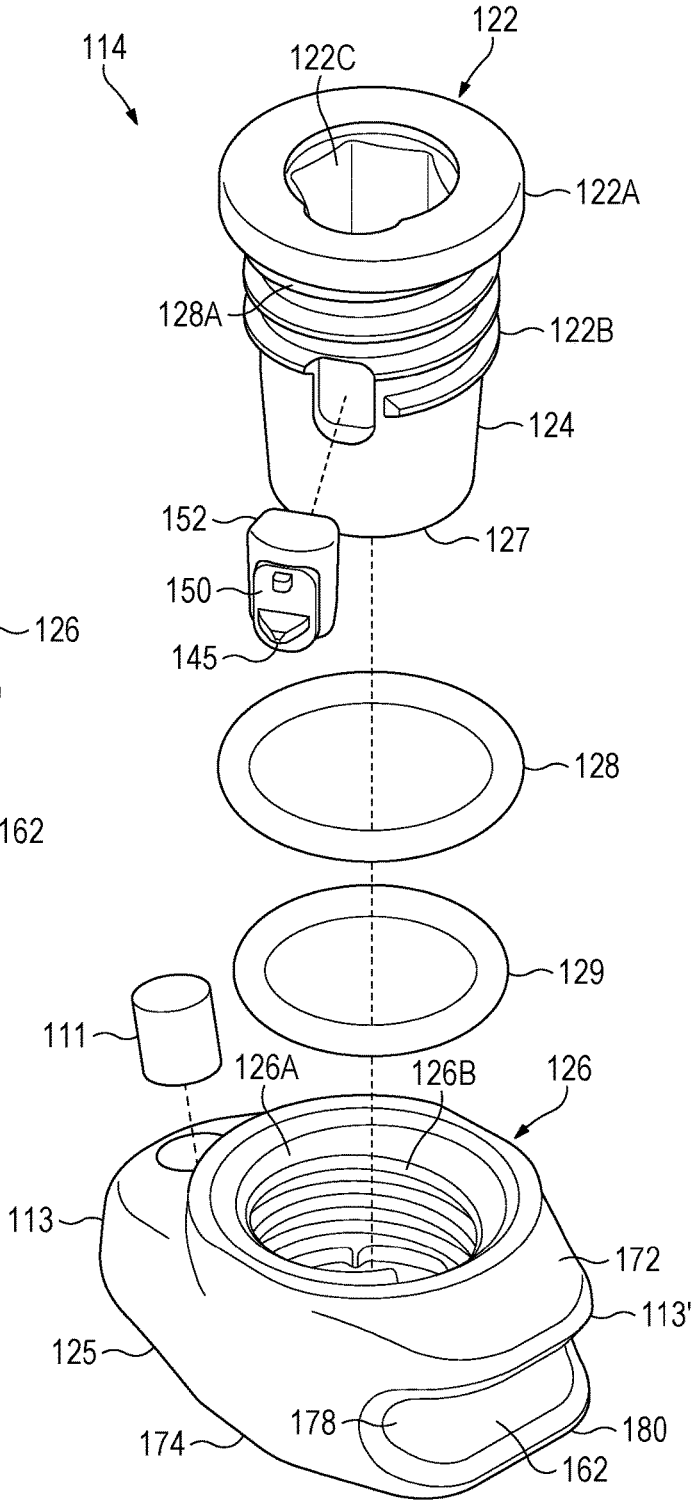
FIG. 12 is an exploded view of the lock of FIG. 10.
Figure 13:
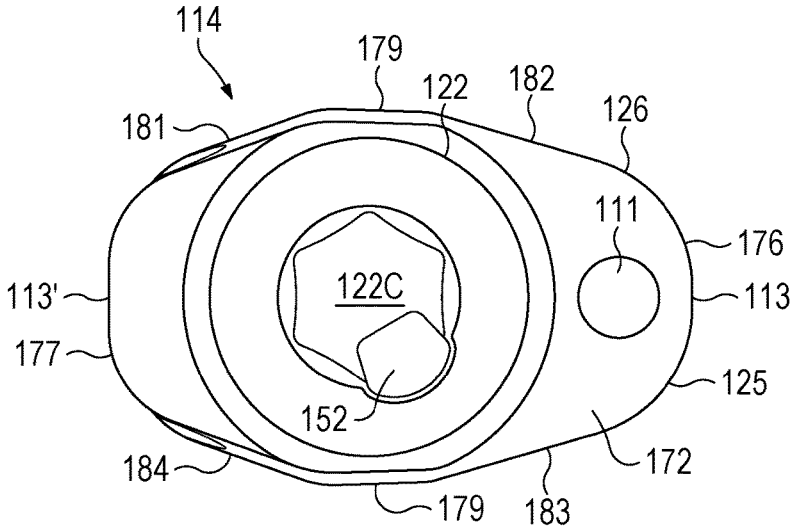
FIG. 13 is a top view of the lock in FIG. 10.

The lock 114 is a coupling arrangement for securing two separable components in an earth working operation. Referring to FIGS. 11-13, the lock 114 in installed in hole 117 in wear member 112. The hole 117 includes a recess or inner portion 116 and a passage or outer portion 118. The lock 114 includes a mounting component or collar 126 and a retaining component or pin 122. The pin 122 being substantially similar to pin 22. The collar 126 has a body 125 that fits in recess 116 of wear member 112 and includes a bore or opening 126A. In the illustrated example, the bore 126A includes threads 1266 for receiving pin 122 with matching threads 1226, but other configurations are possible.

Figure 14:
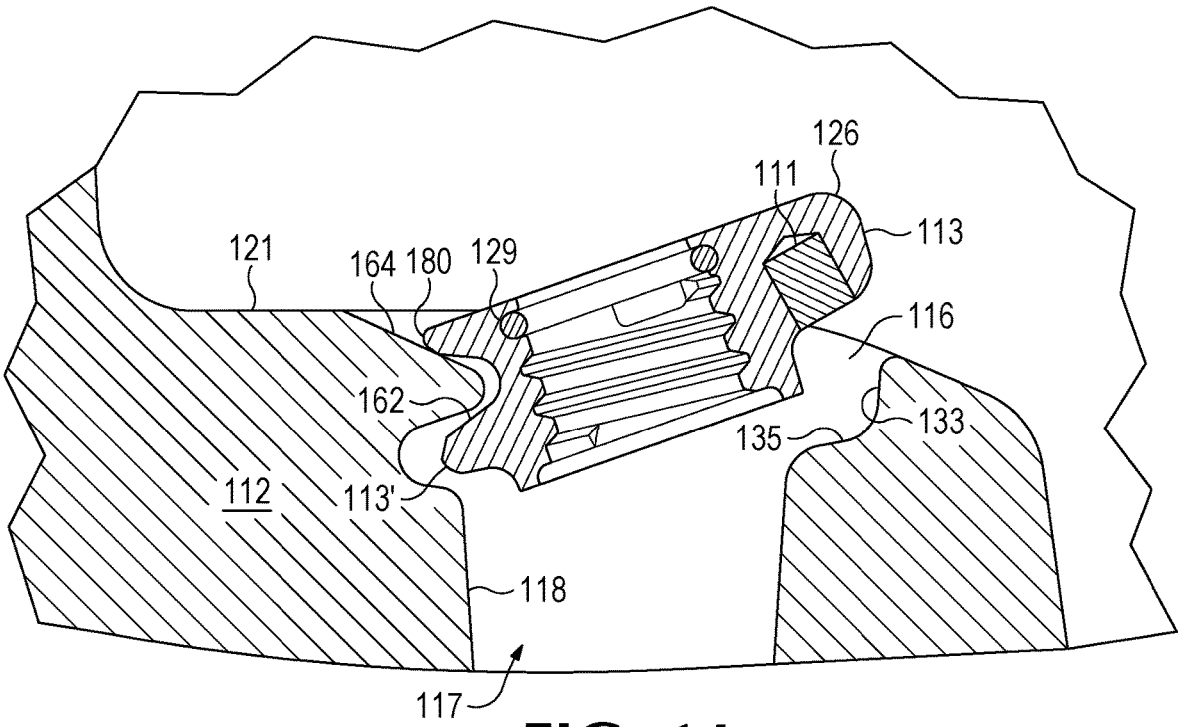
FIG. 14 is a partial cross-section view of the interior of the wear member of FIG. 10 with the lock in the process of installation prior to mounting of the wear member to the base.
Figure 15:
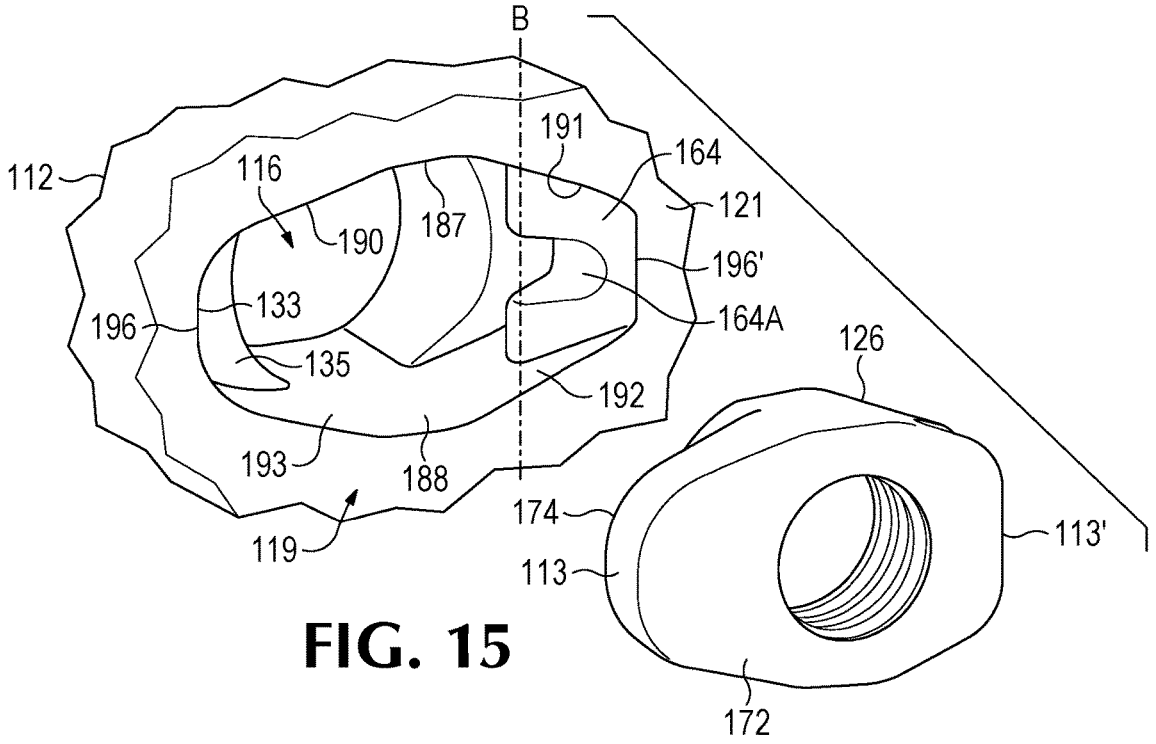
FIG. 15 is a partial exploded view of the wear member and the lock of FIG. 10 prior to the lock installation.

The collar 126 includes at least one magnet 111 to secure the collar 126 and/or lock 114 in the recess 116. In the illustrated example, the magnet 111 is located near an end 113 of the body 125 on a top surface 172 of the collar 126, though other locations are possible. The magnet(s) could alternatively be secured to the wear member 112 in the hole 117. The body 125 includes a coupling structure or anchor feature 162 that is configured to cooperate with a complementary support feature 164 formed in recess 116 (FIG. 14). The anchor 162 and support 164 are configured so that lock 114 can be seated by the interaction of anchor 162 with complementary support 164 from within the interior 121 of the wear member 112, and lock 114 then may be swung outward toward and into recess 116 generally around locking axis of rotation B (FIG. 15). The anchor 162 and support 164 preferably are configured to facilitate a rotation of the lock 114 around axis B. For example, anchor 162 corresponds to a slot that interacts with a support 164 corresponding to a projection or ridge formed in the proximal wall of the lock recess 116 (see FIG. 14). The projection 164 may include an opening 164A, such that the anchor 162 only engages on a top and bottom of the support 164 (FIG. 15). The opening 164A may be included to reduce stress in manufacturing processes. The slot 162 could alternatively be formed on the wear member and the ridge on the lock.

Figure 16:
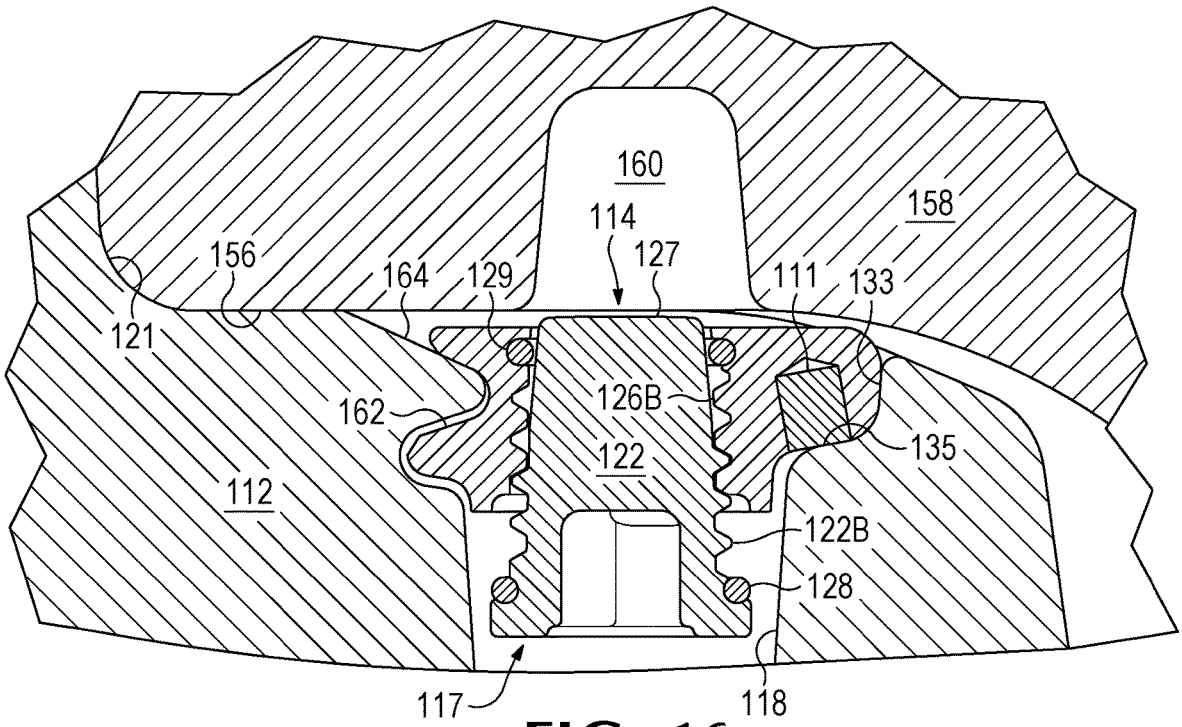
FIG. 16 is a cross-section view with the lock in the release position.

The presence of support 164 and the magnet 111 function to contain the collar 126 or the lock 114 in the first or release position so that the lock 114 does not obstruct installation of the wear member 112 onto the base 158. The magnet 111 in combination with the support 164 holds lock 114 in place within wear member 112, permitting shipment and storage of wear member 112, and to additionally permit the wear member 112 to be installed upon an appropriate base 158, preferably without first moving or removing the lock 114 (e.g. either pin 122 or collar 126) from the aperture 117. However, the base 158 is not needed to hold the lock 114 in the first position, though the opposition of the base to the collar during use prevents the collar from moving out of recess 116. Any outward movement of lock 114 is resisted by support 164 in slot 162, and by the top surface 172 on the end 113 of the lock 114 abutting resisting surface 135 (FIG. 16).

Figure 17:
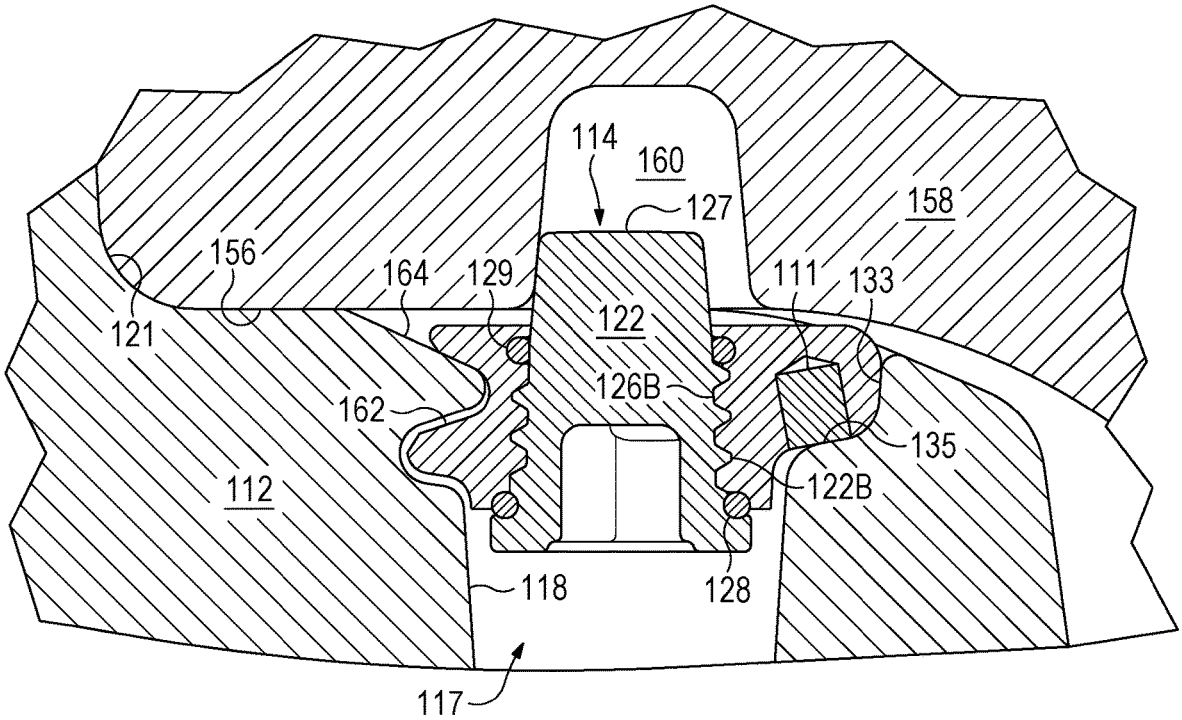
FIG. 17 is a partial cross-section view with the lock in the locked position.
Figure 18:
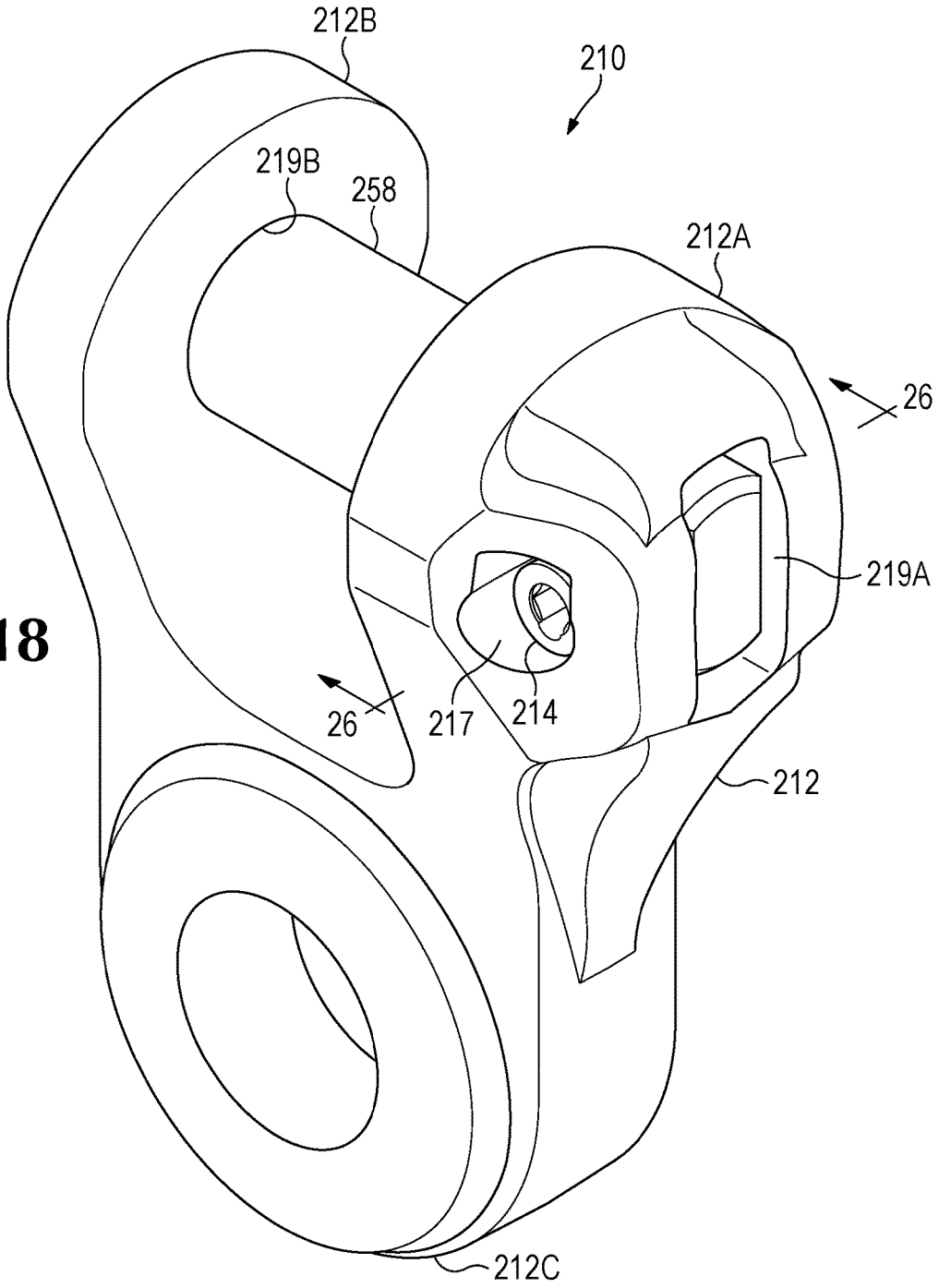
FIG. 18 is a rigging assembly according to the disclosure.
Figure 19:
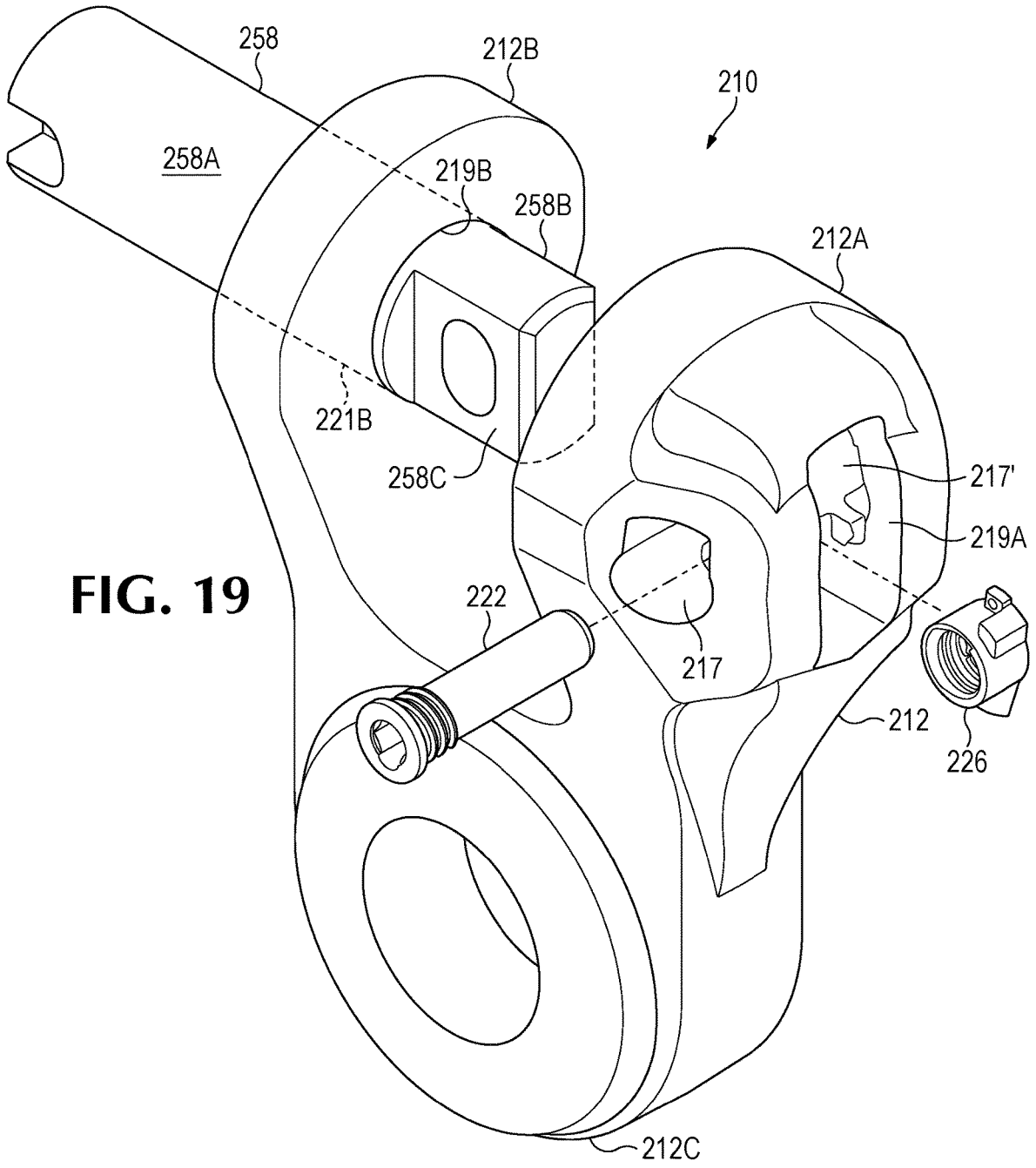
FIG. 19 is a partial exploded view of a rigging assembly of FIG. 18.

The body 125 includes a bottom surface 174 that is similarly shaped to the top surface 172. In one example, the top surface 172 is longer in a lengthwise dimension than the bottom surface 174. The top surface 172 is adjacent a proximal surface 176 and an opposite distal surface 177. The slot 162 defines a curved surface 178, which is adjacent a lower side surface 180 (FIG. 12). The lower side surface 180 in the illustrated example is not engaged by the wear member 112 or base 158 in the shipping and locked positions (FIGS. 16-17). In other examples, the bottom surface 174 may engage the base 158. The body 125 includes lateral side surfaces 179 and two sets of converging surfaces 181-184 that converge towards the ends 113, 113' of the lock 114. In the illustrated example, the converging surfaces 182, 183 converge toward the proximal end 113 and are longer in dimension than the converging surfaces 181, 184 that converge toward the distal end 113', but other configurations are possible. For example the converging surfaces 181, 184 may be longer. Also, one pair or none of surfaces 181-184 may converge.

The recess 116 is an opening in the interior surface 121 of the wear member 112 and is structured to receive and cooperate with the collar 126 of the lock 114 (FIG. 15). The lock 114 may be physically coupled to wear member 112 in the release position. The recess 116 surrounds a passage 118 to receive an inner portion of the collar 126 of the lock 114. The hole 117 extends through a wall of the wear member 112 so as to open to an exterior and to the interior surface 121. The passage 118 may be an elongate circle shape defined by an inner surface 118, but other shapes are possible. The recess 116 includes a portion 133 that is sized and shaped to mate with the body 125 of the collar 126. The recess portion 133 includes an upper and lower surface 187, 188, converging surfaces 190,193 that taper toward the rear, and converging surfaces 191,192 that taper toward the front. The upper and lower surfaces 187, 188 and converging surfaces 190-193 act as anti-rotational surfaces when the pin is being rotated within the pass through aperture in the collar, but other arrangements are possible. The converging surfaces 190-193 reduce the size of hole 117 and aid in point strength and manufacturability.

Referring to FIG. 14, to install the lock 114, the collar 126 is inserted into recess 116 from within the cavity 119 of the wear member 112. The collar 126 is rotated outward about the support 164 (along axis B) and the magnet 111 magnetically engages a recessed surface 135 in the recess 116 on the proximal side 113 of the lock 114 and an outer portion of the lock 114 is received within the passage 118. The recess 116 including a shelf surface 133 in which one end 113 of the collar 126 engages. In the illustrated embodiment, lock 114 and magnet 111 set against shoulder 135. The magnet though could be located to set against other surfaces of the wear member. Further, the cooperation of the shelf surface 133, shoulder 135, and the ridge 164 provide a resistive couple against cantilever and other loads applied to pin 122 during use. The opposition of the base 158 to the collar 126 when wear member 112 is assembled on the base 158 prevents the collar 126 from moving out of recess 116 during use. The pin 122 is then threaded into collar 126. The collar and pin could be installed as a unit with adjustments to hole 117 to provide clearance for the pin as the collar is rotated into recess 116.

Referring to FIGS. 16-17, the lock 114 has two positions as discussed above. The pin 122 is installed into collar 126 from outside the wear member 112 so that a leading end 127 and pin threads 122B engage collar threads 126B. In the release or shipping position, lock 114 is also constrained against outward movement by ridge 164 being received in slot 162 and a magnet 111 attaching to a shelf surface 135 (FIG. 16). If the magnet 111 should fail, the pin 122 would stop the collar 126 from rotating out. Twisting of lock 114 in the installed position is resisted by ridge 164 in slot 162, and the close proximity of the marginal walls 133, 135, 187, 188, 190-193 of hole 117 with the lock 114. Further twisting moves the pin 122 to the locked position, where only a portion of the leading end 127 engages the hole 160 of the base 158 to hold the wear member 112 to the base 158 (FIG. 17).

To remove the wear member 112, the pin 122 may be released using a torque applying tool (e.g., a torque wrench) to unscrew pin 122 from collar 126 back to the release or shipping position (FIG. 16) while remaining in a hole 117. While pin 122 can be removed from collar 126, it need only be backed up to the release position without completely removing the pin 122. Wear member 112 can then be removed from nose 158.

In the illustrated example of FIG. 18-26, a rigging assembly 210 is shown that includes a wear member 212, a rigging pin or separable component 258, and a lock 214. In the illustrated example, the wear member 212 is shown as a Y connector having arms 212A, 212B each with a respective opening 219A, 219B. Each of the openings 219A, 219B are defined by an interior surface 221A, 221B for receiving the rigging pin 258. In this example, the rigging pin 258 has a cylindrical body 258A and a head 258B provided with flats 258C or other non-round configuration. Pins with other configurations could be used.

A base end 212C is provided on the opposite end of Y connector 212. Rigging component 212 is typically part of a rigging assembly and is secured to other components (e.g., other rigging components, chains, bucket parts, etc.) via the rigging pin 258 (i.e., between arms 212A, 212B, and via the aperture in base end 212C. While a Y connector rigging component is used as an example, a lock 214 could be used to secure the pin in other kinds of rigging components.

Figure 25:
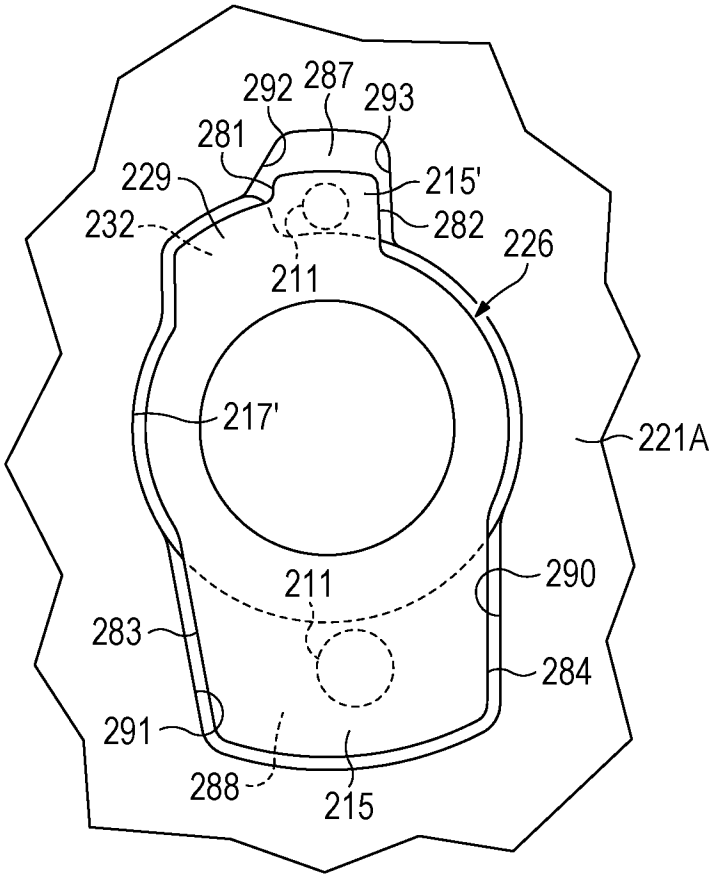
FIG. 25 is a partial perspective view of the interior of the hole of FIG. 24 with the collar installed.
Figure 24:
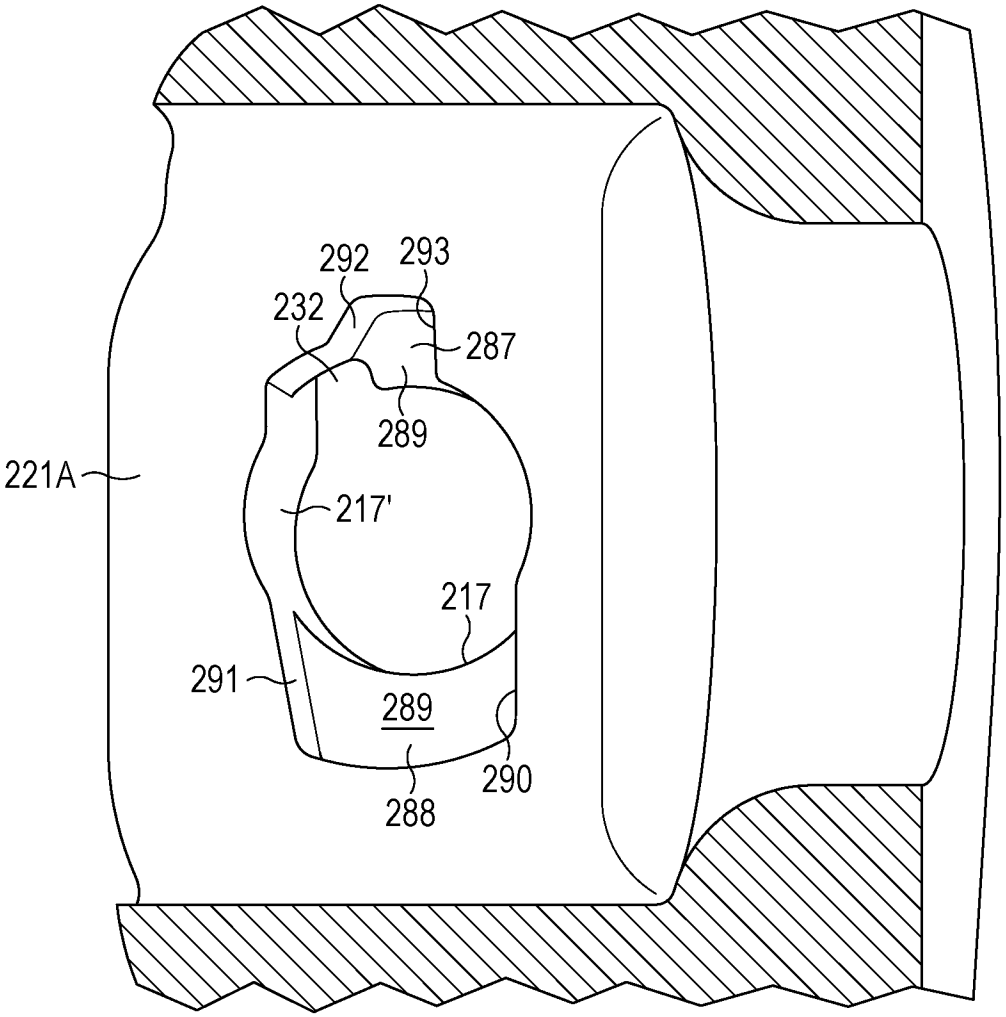
FIG. 24 is a partial cross-section view of the interior of the hole of the wear member of FIG. 18.

Each opening 219A, 219B may be shaped generally to accept the rigging pin 258. A hole 217 extends through arm 212A to intersect opening 219A. A hole 217 may also or alternatively be located in arm 212B (not shown). The hole 217 includes an inner portion or recess 217' that opens to the interior 221 of the opening 219A. The recess 217' is structured to receive and cooperate with the main body 225 of the collar 226 of the lock 214. The outer portion of hole 217 may be an elongate circle shape defined by an inner surface 218, but other shapes are possible. The outer portion or passage 216 of hole 217 is sized and shaped to mate with at least an outer portion 231 of the collar 226 of the lock (FIG. 25). The recess 217' may include opposite grooves 287, 288 that may include side surfaces 290-293. The side surfaces 290-293 may act as anti-rotational surfaces when the pin 222 is being rotated within the pass through aperture 226A in the collar 226, but other arrangements are possible (FIGS. 24-25). The hole 217 may further include a relief 232 that communicates with the passage 218 and the recess 217' (FIG. 24).

Figure 20:
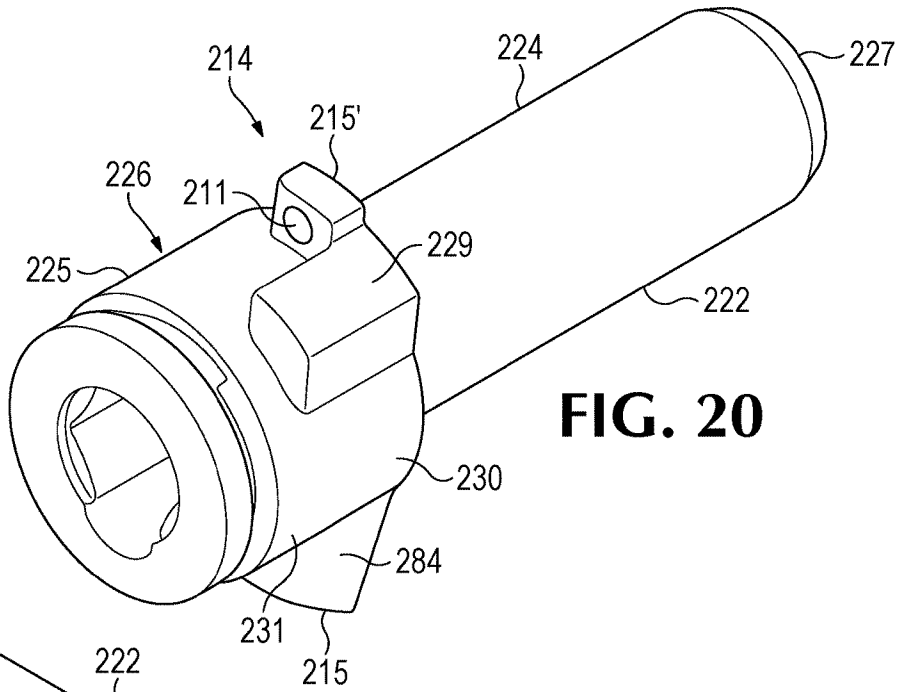
FIG. 20 is a perspective view of the lock of FIG. 18.
Figure 21:
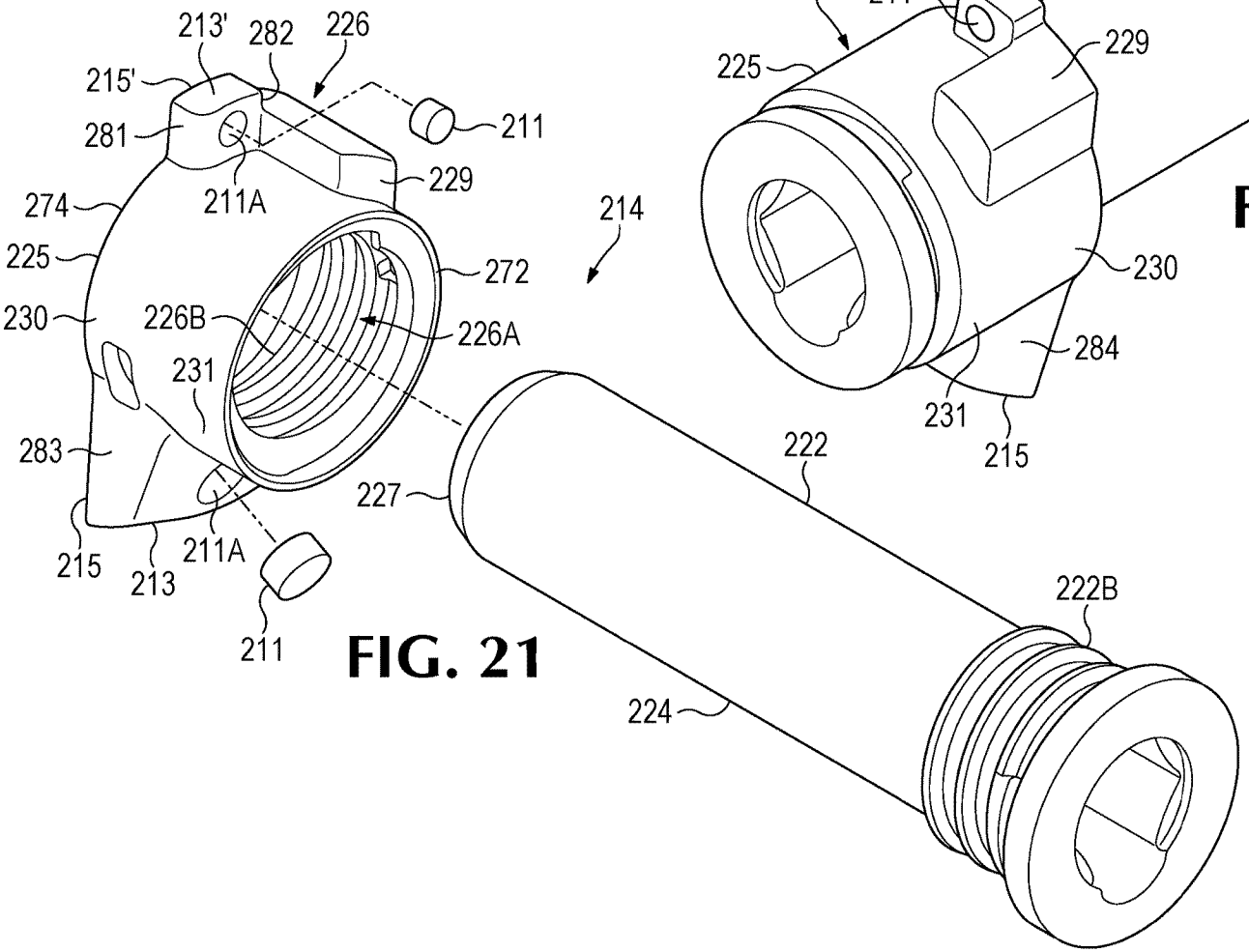
FIG. 21 is an exploded view of the lock of FIG. 18.
Figure 22:
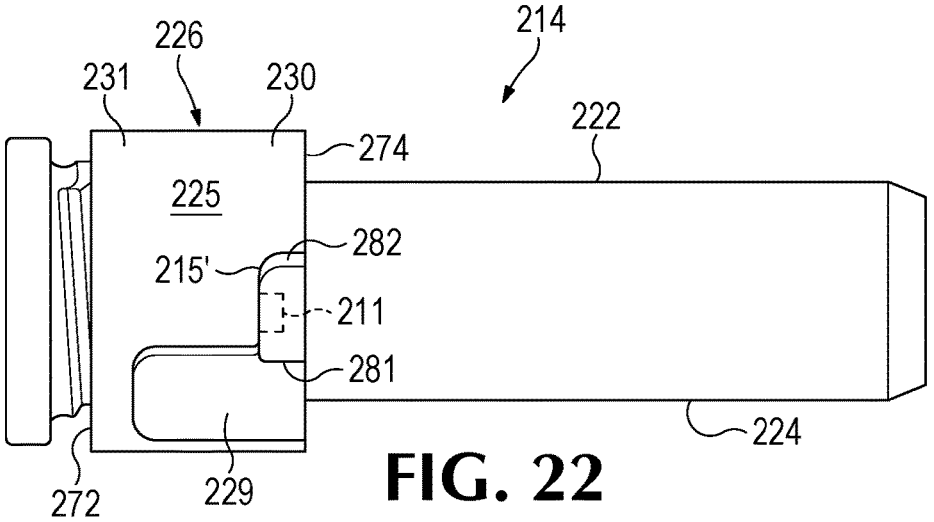
FIG. 22 is a side view of the lock in FIG. 18.
Figure 26:
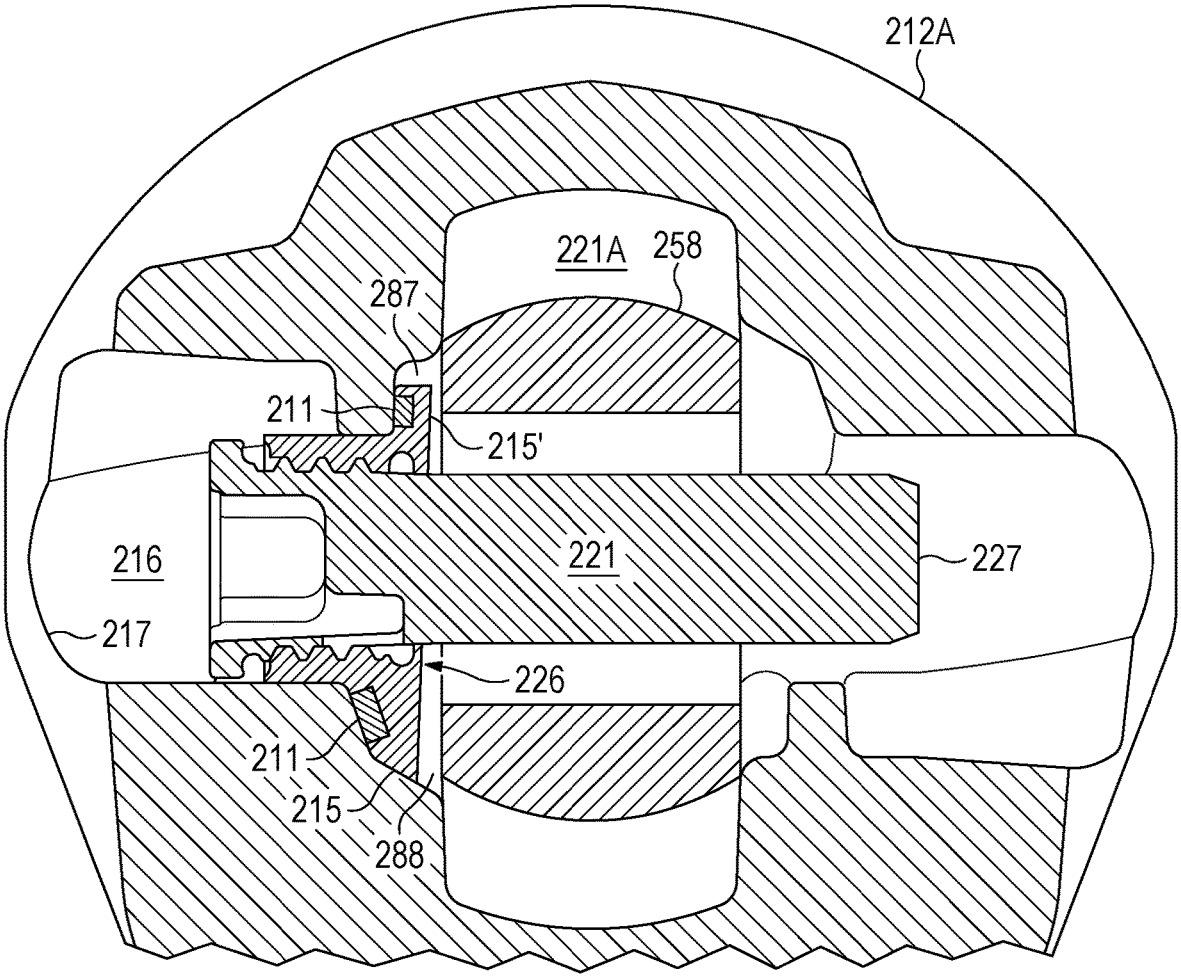
FIG. 26 is a partial cross-section view taken along line 26-26 in FIG. 18 with the lock in the locked position.

The rigging wear member 212 is a coupling arrangement for securing two separable components in an earth working operation. Lock 214 secures the rigging pin 258 in wear member 212. Referring to FIGS. 20-22, the lock 214 includes a mounting component or collar 226 and a retaining component or pin 222. The pin 222 may be substantially similar to pin 22. The pin 222 is illustrated as having a longer shank 224 than pin 22. A longer pin such as pin 222 could optionally be used to secure a wear member in the form of a ground-engaging tool (e.g., a point) to a base (e.g., an adapter nose). In such an arrangement, the pin could extend through the base and engage both sidewalls of the point. Also, a shorter pin could be used in a rigging member. The collar 226 is installed in hole 217 and recess 217' before the pin 222. In this example, the collar would be installed through open outer end in arms 212A that is formed by an extension of opening 219A to the outer exterior sidewall of arms 212A. The pin 222 of the lock 214 passes through the hole 217 and into one opening 219A (FIG. 26).

The collar 226 has a body 225 that fits into the lock receiving recess 217' in arm 212A of wear member 212 and extends into passage 218. The body 225 may be cylindrically shaped and include a bore 226A. In the illustrated example, the bore 226A includes threads 226B for receiving pin 222 with matching threads 222B, but other configurations are possible. The illustrated bore includes threads 226B for receiving the pin 222 with matching threads 222B, but other configurations without threads to secure and move the pin relative to the collar are possible (e.g. prying latches, oil pressure, etc.).

In the illustrated example, the body 225 includes an inner portion 230 that is received in the recess 217' and an outer portion 231 that is received in the hole 217. The inner portion 230 is elongated to be larger than the hole 217 to resist outward movement during use. The inner portion 230 is smaller for receipt into the hole 217 to ensure alignment of bore 226A with hole 217 and/or provide a longer run of threads. Nevertheless, other collar shapes are possible.

The body 225 may be further defined by at least two projections 215, 215' extending outward from the cylindrical portion of the body 225. The projections 215, 215' may be sized and shape to fit within the grooves 287, 288 in the lock receiving area 217'. One of the projections 215, 215' may have a different length or shape than the other. In the illustrated example, a third projection 229 may be situated into the relief 232 that extends from the hole 217 into the lock receiving area 217'.

The collar 226 includes at least one magnet 211 to secure the collar 226 and, thus, lock 214 in recess 217'. In the illustrated example, two magnets 211 are located near each respective end 213, 213' on an outer surface 30 of the two projections 215, 215' of the collar 226, though other locations and numbers of magnets 211 are possible. The magnets 211 are illustrated as being at different elevations, such that one magnet 211 is higher than the other, but other configurations are possible. The magnets 211 are shown as different in size, but may also be the same. Each magnet 211 may be installed into an open-ended hole 211A or otherwise secured to the collar 226. The magnets 211 and holes 211A are similar to the magnets 11 and hole 11A discussed above. The magnets 211 can hold the collar 226 in place during shipment, storage, and/or installation of wear member 212. This arrangement can permit the rigging pin 258 to be installed on wear member 212 without first moving or removing the lock 214 from the wear member 212 depending on the length of the shank 224 on the pin 222. In the illustrated example, the lock 214 is only positioned in a locked or unlocked position (FIG. 26). The pin end 227 could be inward of the collar 226 in a release position so long as the pin 222 does not extend far enough to engage or obstruct the rigging pin 258 during installation (not shown).

The body 225 includes a bottom surface 274 that is similarly shaped to the top surface 272. In other examples, the bottom surface 274 may engage the rigging pin 258. The projections 215, 215' includes side surfaces 281-284. These side surfaces may converge towards the ends 213, 213' of the lock 214. In the illustrated example, the converging surfaces 283, 284 converge toward the proximal end 215 and are longer in dimension than the side surfaces 281, 282, but other configurations are possible (diverging, planar, curved, etc.).

Figure 23:
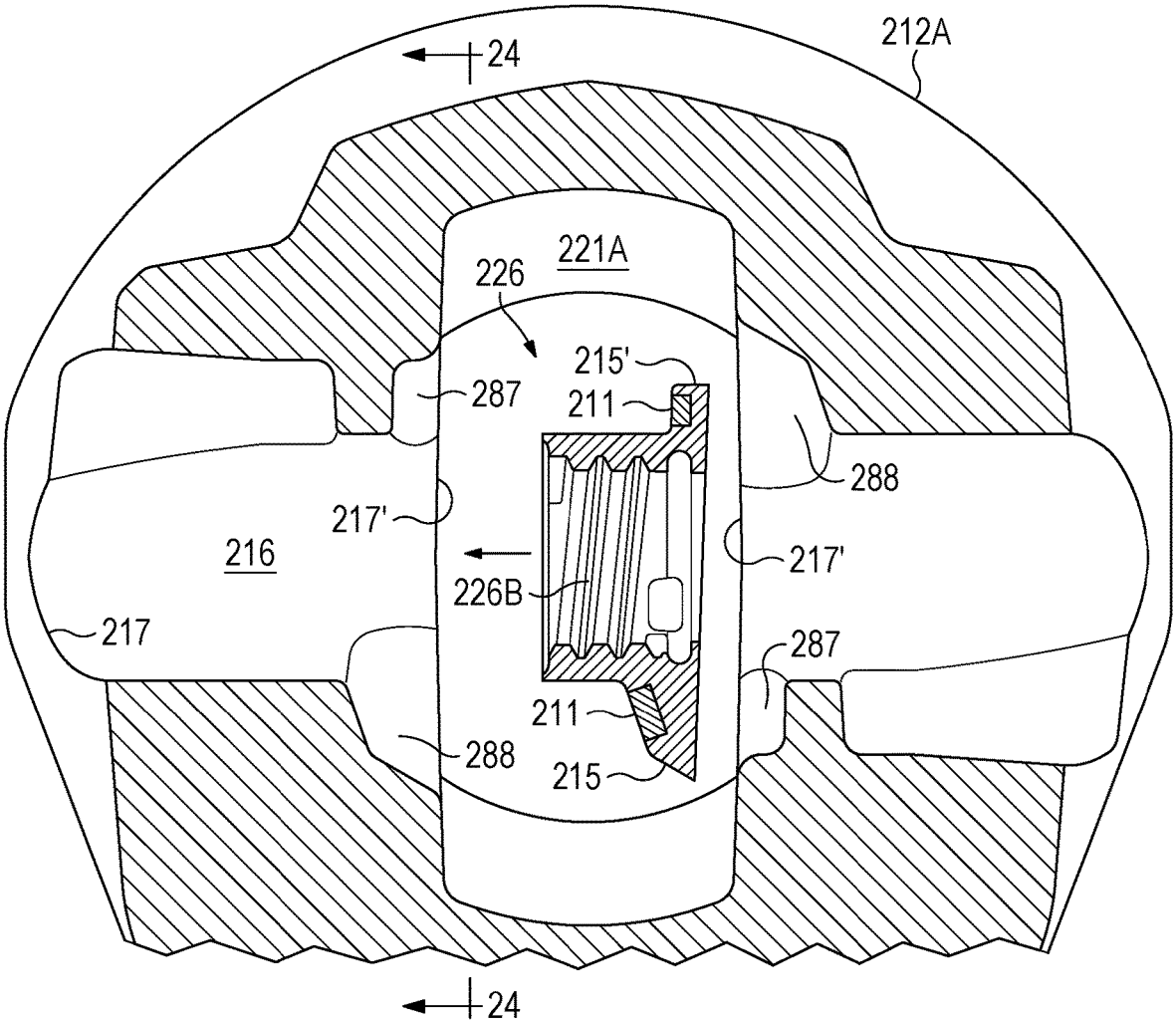
FIG. 23 is a partial cross-section view of the interior of the wear member of FIG. 18 prior to installation of the collar.

Referring to FIG. 23, to install the lock 214, the collar 226 is inserted into recess 217' from within the interior 221 of the wear member 212. The collar 226 is slid into the hole 217 until the magnets 211 magnetically engages a recessed surface 289 in the grooves 287, 288. Further, the cooperation of the magnet 211 and the side surfaces of the grooves 287, 288 provide a resistive couple against cantilever and other loads applied to pin 222 during use. Rigging pin 258 is inserted into rigging member 212 after installation of the collar. The collar could be installed at the time of manufacture, in inventory or in the field. The opposition of the rigging pin 258 to the collar 226 when the rigging pin 258 is installed on the wear member 212 prevents the collar 226 from moving out of recess 217' during use. The pin 222 is then threaded into collar 226 (FIG. 26).

The invention claimed is:

1. A wear assembly for earth working equipment comprising:

a wear member including an exterior surface, an opening defined by an interior surface to receive a separable component, and a hole extending from the exterior surface to the opening, the hole including an inner portion formed in the interior surface and an outer portion extending between the exterior surface and the inner portion, wherein the inner portion extends beyond the outer portion to define a resisting surface within the inner portion adjacent the outer portion;

a lock in the hole to secure the separable component to the wear member, wherein the lock includes a collar and a pin that is adjustable within the collar so that the pin is movable inward to retain the separable component in the opening and movable outward to release the separable component, wherein the collar is in the inner portion adjacent the resisting surface which holds the collar from moving outward; and a magnet to secure the collar in the inner portion of the hole prior to receiving the separable component in the opening.

2. The wear assembly of claim 1, wherein the wear member is a ground engaging tool and the separable component is a nose for mounting the wear member to a digging edge of an earth working equipment.

3. The wear assembly of claim 1, wherein the wear member is a rigging component and the separable component is a rigging pin.

4. The wear assembly of claim 1, wherein the magnet is secured to the wear member.

5. The wear assembly of claim 1, wherein the magnet is secured to the collar.

6. The wear assembly of claim 1, wherein the collar includes a body set in the recess, the body includes a threaded bore to receive the pin therein, and the pin includes threads.

7. The wear assembly of claim 6, wherein the magnet is secured to the collar.

8. A wear assembly for earth working equipment comprising:

a wear member for earth working equipment comprising an exterior surface, an opening defined by an interior surface for receiving a separable component, a hole extending from the exterior surface to the opening, the hole having an outer portion adjacent the exterior surface and an inner portion defined in the interior surface to form a recess in the opening wherein the recess extends beyond the outer portion to define a resisting surface, and a pivot support on one side of the recess; and a lock in the hole wherein the lock includes a collar and a pin that is adjustable within the collar to move inward to retain the separable component in the opening and outward to release the separable component, the collar including a pivot formation to engage the pivot support to pivot the collar into the recess prior to receiving the separable component in the opening such that the collar sets adjacent the resisting surface which holds the lock from moving outward.

9. The wear assembly of claim 8, wherein a magnet is secured to the wear member.

10. The wear assembly of claim 8, wherein a magnet is secured to the collar.

11. The wear assembly of claim 8, wherein the wear member is a ground engaging tool and the separable component is a nose for mounting the wear member to a digging edge of an earth working equipment.

12. The wear assembly of claim 8, wherein the wear member is a rigging component and the separable component is a rigging pin.

13. The wear assembly of claim 8, wherein the collar is pivoted about the pivot support to move about a pivot axis that is transverse to the extension of the hole from the exterior surface to the opening.

14. The wear assembly of claim 13, wherein the opening includes a front end and an open rear end through which the separable component is received, and the pivot support is on the one side of the recess that is closest to the front end of the opening.

15. The wear assembly of claim 14, wherein the pivot formation is an indentation and the pivot support is a projection that fits into the indentation in the collar.

16. The wear assembly of claim 15, wherein the magnet is secured to the collar.

17. The wear assembly of claim 16, wherein the collar includes a body set in the recess, the body includes a threaded bore to receive the pin therein, and the pin includes threads.

18. The wear assembly of claim 8, wherein the opening includes a front end and an open rear end through which the separable component is received, and the pivot support is on the one side of the recess that is closest to the front end of the opening.

19. A wear member for earth working equipment comprising:

an exterior surface, an opening defined by an interior surface for receiving a separable component, a hole extending from the exterior surface to the opening, the hole having an outer portion adjacent the exterior surface and an inner portion defined in the interior surface to form a recess in the opening wherein the inner portion extends beyond is the outer portion to define a shoulder in the recess to hold the collar from moving outward, and a pivot support on one side of the recess to facilitate pivoting of a collar of a lock into the recess so the lock can retain the separatable component in the opening.

20. The wear member of claim 19, wherein the recess includes a magnet opposite the pivot support.

21. The wear member of claim 19, wherein the wear member is a ground engaging tool.

22. The wear member of claim 19, wherein the pivot support is a projection that includes an opening in the center thereof.

23. The wear member of claim 19, wherein the pivot support is an indentation interacting with a projection in the collar.

24. The wear member of claim 19, wherein the opening includes a front end and an open rear end through which the separable component is received, and the pivot support is on the one side of the recess that is closest to the front end of the opening.

25. The wear member of claim 24, wherein the collar is pivoted about the pivot support to move about a pivot axis that is transverse to the extension of the hole from the exterior surface to the opening.

26. The wear member of claim 25, wherein the shoulder includes at least one portion on a side of the recess that is opposite the one side with the pivot support.

27. The wear member of claim 19, wherein the collar is pivoted about the pivot support to move about a pivot axis that is transverse to the extension of the hole from the exterior surface to the opening.

28. The wear member of claim 19, wherein the shoulder includes at least one portion on a side of the recess that is opposite the one side with the pivot support.

29. The wear member of claim 19, wherein the shoulder includes at least one portion on a side of the recess that is opposite the one side with the pivot support.

30. The wear member of claim 19, wherein the pivot support is a projection that fits into a complementary recess in the lock.

31. The wear member of claim 19, wherein the wear member is a rigging component.

* * * * *